US011988071B2

(12) United States Patent
Rogers et al.

(10) Patent No.: US 11,988,071 B2
(45) Date of Patent: May 21, 2024

(54) DRILL STRING-CONNECTED PROTECTION FROM BOREHOLE PULSATION ENERGIES

(71) Applicant: Performance Pulsation Control, Inc., Richardson, TX (US)

(72) Inventors: John Thomas Rogers, Garland, TX (US); Cersten Jantzon, Kingwood, TX (US)

(73) Assignee: Performance Pulsation Control, Inc., Richardson, TX (US)

( * ) Notice: Subject to any disclaimer, the term of this patent is extended or adjusted under 35 U.S.C. 154(b) by 105 days.

(21) Appl. No.: 17/646,459

(22) Filed: Dec. 29, 2021

(65) Prior Publication Data

US 2022/0205324 A1 Jun. 30, 2022

Related U.S. Application Data

(60) Provisional application No. 63/131,727, filed on Dec. 29, 2020.

(51) Int. Cl.
*E21B 21/08* (2006.01)
*E21B 4/02* (2006.01)
*E21B 17/18* (2006.01)

(52) U.S. Cl.
CPC ..... *E21B 4/02* (2013.01); *E21B 17/18* (2013.01); *E21B 21/08* (2013.01)

(58) Field of Classification Search
CPC ..... E21B 21/08; E21B 17/07
See application file for complete search history.

(56) References Cited

U.S. PATENT DOCUMENTS 3,444,897 A * 5/1969 Erickson ..... G05D 7/012 138/45
4,644,974 A * 2/1987 Zingg ..... B05B 1/00 138/40
5,515,336 A 5/1996 Chin et al.
2005/0194183 A1* 9/2005 Gleitman ..... E21B 36/04 175/45
2006/0243489 A1 11/2006 Wassell et al.
(Continued)

OTHER PUBLICATIONS

International Search Report and Written Opinion of the International Searching Authority in connection with International Application No. PCT/US2021/065570 dated Mar. 17, 2022, 11 pages.

*Primary Examiner* — Giovanna Wright

(57) ABSTRACT

A pulsation dampening device includes a body having an upper connection end and a lower connection end, each connection end adapted to connect the body to connectors for a drill string pipe segment that are part of one of a top drive, a lower Kelly valve, a saver sub, drill string sub, a drill string pipe and a bottom hole assembly. Flow restriction is provided within an internal flow path extending axially through the body and is configured to reduce pumped fluid pressure pulses originating from an agitator within downhole tools. The flow restriction is provided by a combination of one or more orifice(s) restricting fluid flow within the internal flow path, optionally coupled with relief feature(s) gradually increasing or decreasing a cross-section of the internal flow path, or by an orifice device. Flow restriction operates unidirectionally or bidirectionally relative to predominant fluid flow in attenuating pressure pulses.

20 Claims, 12 Drawing Sheets

(56) References Cited

U.S. PATENT DOCUMENTS

| | | | | |
|---|---|---|---|---|
| 2007/0044956 | A1* | 3/2007 | Jonas | E21B 34/10 166/179 |
| 2010/0148987 | A1* | 6/2010 | Spross | E21B 47/18 340/854.3 |
| 2010/0224409 | A1 | 9/2010 | Sarhad et al. | |
| 2014/0102804 | A1 | 4/2014 | Cote | |
| 2015/0034165 | A1 | 2/2015 | Conn et al. | |
| 2019/0128462 | A1 | 5/2019 | Rogers | |
| 2019/0277110 | A1 | 9/2019 | Shampine | |
| 2019/0278306 | A1* | 9/2019 | Shampine | F04F 13/00 |
| 2020/0011159 | A1 | 1/2020 | Dykstra et al. | |

* cited by examiner

DRILL STRING-CONNECTED PROTECTION FROM BOREHOLE PULSATION ENERGIES

CROSS-REFERENCE TO RELATED APPLICATIONS

This application claims priority to U.S. Provisional Patent Application No. 63/131,727 filed Dec. 29, 2020. The content of the above-identified patent document(s) is incorporated herein by reference.

TECHNICAL FIELD

The present application relates generally to the operation of pulsation emitting borehole or drill string equipment and reciprocating fluid transfer systems and, more specifically, to providing one or more pulsation control products and/or devices within or connected to a drill string. Pulsation control device means a device which dampens or reduces one or more of surface vibration, flow variation, acceleration and acoustic energies.

BACKGROUND

Downhole, drill string agitators, either with or without shock tools, work by emitting or discharging fluid pulsations. This creates a need to for a device to reduce the pulsation energy and vibration experienced at the surface in the top drive, Kelly hose, derrick, standpipe and other surface components. Another desirable benefit is to reduce the interaction from the pump pulsation energies with the downstream system and increasing flexibility in integration of pulsation dampeners with other elements of an overall pump system improvement.

SUMMARY

A pulsation dampening device for connection to or within a drill string includes a body having an upper connection end and a lower connection end, the upper connection end adapted to connect to one of a top drive, a lower Kelly valve (which may include an inside blowout preventer or "iBOP"), or a first drill string pipe section or other device such as a saver sub, the lower connection end adapted to connect to the drill string pipe. In embodiments of this disclosure, the device replaces the traditional saver sub and provides both the function(s) of the saver sub as well as those of a pulsation dampening device. An internal flow path extends through an axial length of the body, the internal flow path including features configured to provide vibration, acoustic, flow and acceleration energy reductions by using disruption features attenuating fluid pressure pulses originating from downhole tools, such as an agitator. The internal flow path can also attenuate/disrupt residual acoustic, flow, and acceleration energies from the mud pumps.

The internal flow path optionally includes: a throat; an orifice adjacent the throat, where the orifice includes sharp edges or other edge geometries as may be beneficial, and restricts fluid flow through the internal flow path to a cross-sectional area that is smaller than a cross-sectional area for fluid flow through the internal flow path in a region of the throat; and a relief feature (where the term "relief feature" is defined as stated herein) disposed on an opposite side of the orifice from the throat, the relief feature providing either an abrupt (e.g. stepped) or a gradual (e.g., conical) increase in the cross-sectional area of the internal flow path and causing, together with the orifice, a pressure drop within fluid passing through the internal flow path.

The orifice may be one of first and second (or more) orifices and the relief feature may be one of first and second (or more) relief features, each orifice/relief feature pair spaced apart along the internal flow path, forming a two or more orifice, unidirectional pressure drop feature.

The orifice may be one of (at least) first and second orifices and the relief feature may further provide a gradual or abrupt decrease in the cross-sectional area of the internal flow path adjacent to or spaced apart from the gradual or abrupt increase in the cross-sectional area of the internal flow path, forming a two or more orifice, bidirectional pressure drop feature.

A spacing between the orifice and the relief feature is preferably selected based on a waveform of pulsation energy within fluid pressure pulses to be attenuated, resulting in the pulsation dampener having a length possibly up to the length of a drill pipe or sub segment.

The orifice and the relief feature may be integral and permanent portions of the internal flow path or may be provided as a removable insert secured within the internal flow path.

The internal flow path may alternatively include a flow restriction orifice assembly disposed therein.

The pulsation dampening device may be implemented as a saver sub connected between a top drive's lower Kelly valve (iBOP) and a drill string, or as a connector sub between downhole drill pipe segments within a drill string that are disposed within a borehole.

A drilling assembly may include multiple pulsation dampening devices each connected at a different one of multiple locations within a drill string between a top drive and the downhole tools (e.g., an agitator, for example) and possibly a bottom hole assembly (BHA), located between the agitator and bottom hole assembly and drill bit.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; and the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 21, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged standpipe manifold dampener or system dampener that can be used to control or partially control pulsation amplitudes.

Reciprocating systems, such as reciprocating pump systems and similar equipment used to circulate the mud or drilling fluid on a drilling rig, are known to induce pressure peaks within the pumped fluid that will accelerate, with each pulsation, the deterioration of the pump, the pump's fluid end expendable parts, and equipment downstream from the pump.

Contemporary drilling systems also include other sources of pumped fluid pressure variation and/or vibration, such as downhole agitators and shock tools. Also known as a drilling agitator tool, these devices vibrate the drill string with low frequency, low amplitude axial vibration to reduce drag (friction or "stick") causing low penetration rates (rate of penetration or "ROP") and/or poor tool face control. Often the vibration is created by inducing pressure variations in the pumped fluid. In addition to providing an additional source of pressure pulses and vibration in the pump system, the agitator's action can potentially resonate with mud pump pressure fluctuations, increasing the mechanical effects. Pulsation control equipment is typically placed immediately upstream or downstream from a reciprocating pump, often with a relative size and configuration proportional to the volume of desired fluid displacement per stroke of the pump and the maximum allotted magnitude of the pressure peaks that may be experienced by the pump system during each pulsation. Pulsation control equipment thus aids in reducing pump loads and minimizing pulsation amplitudes to the pump, the pump's fluid end expendable parts and to equipment upstream or downstream. As a result, pulsation control equipment increases the relative operating performance and life of the pump, the pump's fluid end expendable parts and any equipment upstream or downstream from the pump.

Pumped fluid pressure pulsations experienced far downstream from the mud pumps, such as those within the drill string (between the top drive or Kelly and the drill bit), may not be accounted for or attenuated by a pulsation dampener at the pump outlet. The resulting fluid pressure pulsations and/or vibration interaction can cause damage to drilling components and increase noise for downstream measurement instruments and sensors.

Figure 1:
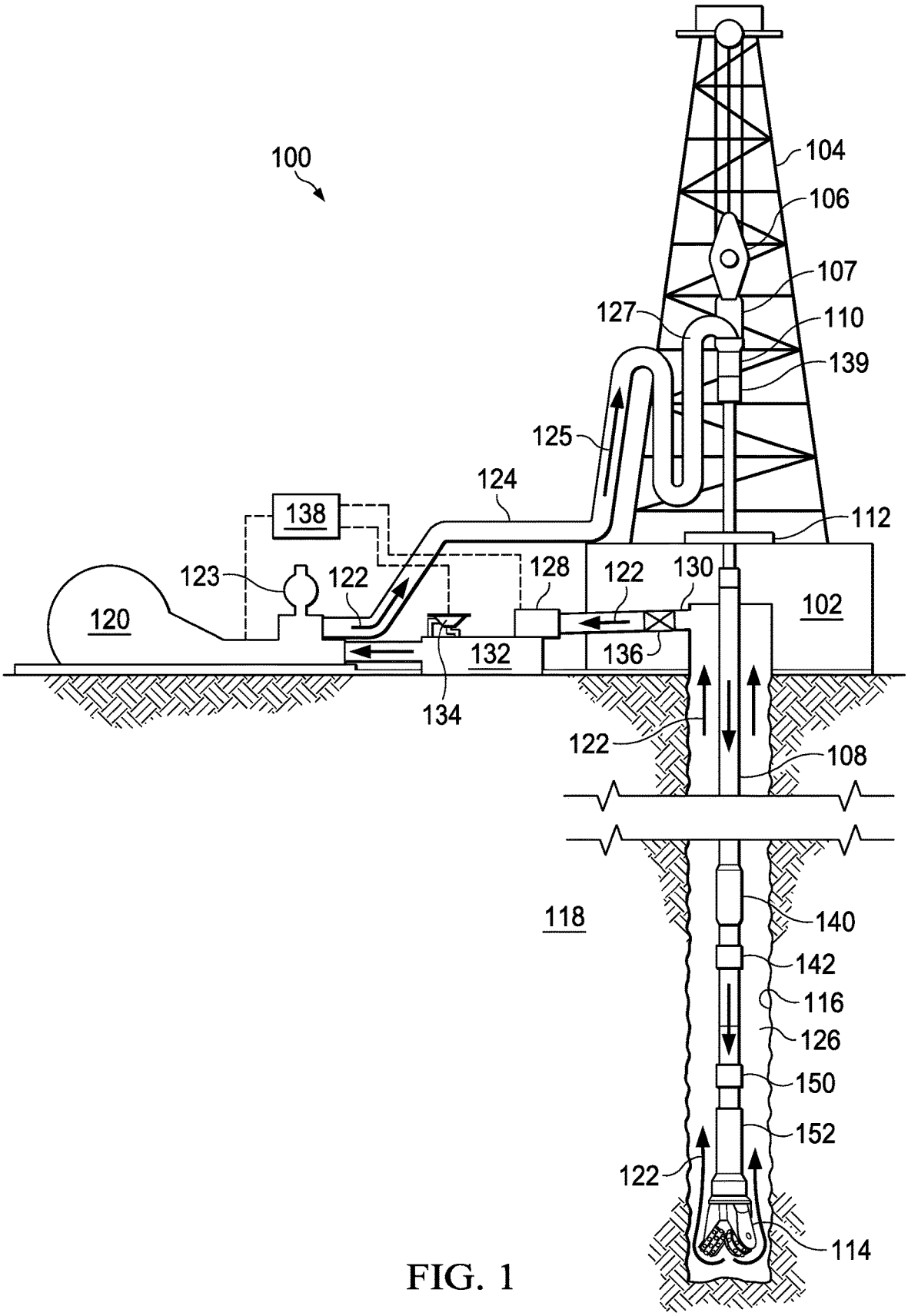
FIG. 1 illustrates a diagrammatic view of a drilling system including one or more drill string-connected pulsation dampener(s) according to various embodiments of the present disclosure.

FIG. 1 illustrates a diagrammatic view of a drilling system including one or more drill string-connected pulsation dampener(s) according to various embodiments of the present disclosure. The embodiment of the drilling system 100 illustrated in FIG. 1 is for illustration only. FIG. 1 does not limit the scope of this disclosure to any particular implementation of a drilling system. In particular, while FIG. 1 generally depicts a land-based drilling assembly, those skilled in the art will readily recognize that the principles described herein are equally applicable to subsea drilling operations that employ floating or sea-based platforms and rigs without departing from the scope of the disclosure.

Referring now to FIG. 1, the drilling system 100 may include a drilling platform 102 that supports a derrick 104 having a traveling block 106 and swivel 107 for raising and lowering a drill string 108. The drill string 108 may include, but is not limited to, drill pipe and coiled tubing, as generally known to those skilled in the art. typically, a lower Kelly valve 110, which may include an inside blowout preventer (iBOP), is connected to the drill string 108 as the drill string 108 is lowered through a rotary table 112. Those skilled in the art understand that a top drive may be used with the drill string 108. A drill bit 114 is attached to the distal end of the drill string 108 and is driven either by a downhole mud motor and/or via rotation of the drill string 108 from the well surface. As the bit 114 rotates, the drill bit 114 creates a borehole 116 that penetrates various subterranean formations 118.

A pump 120 (e.g., a "mud pump") circulates mud (drilling fluid) 122 through a feed pipe 124, standpipe 125, and rotary Kelly hose 127, and to the Kelly 110, which conveys the mud 122 downhole through the interior of the drill string 108 and out through one or more orifices in the drill bit 114. Mud 122 is then circulated back to the surface via an annulus 126 defined between the drill string 108 and the walls of the borehole or casing 116. At the surface, the recirculated or spent mud 122 exits the annulus 126 and may be conveyed through chokes 136 (also referred to as a choke manifold) to one or more mud cleaning unit(s) 128 via an interconnecting flow line 130. After passing through the mud cleaning unit(s) 128, "cleaned" mud 122 is deposited into a nearby retention pit 132 (e.g., a mud pit or mud tank). While illustrated as arranged at the outlet of the borehole 116 via the annulus 126, those skilled in the art will readily appreciate that the mud cleaning unit(s) 128 may be arranged at any other location in the drilling assembly 100 to facilitate proper function, without departing from the scope of the disclosure. The addition of materials to the mud 122 may be achieved with a mixing hopper 134 communicably coupled to or otherwise in fluid communication with the retention pit 132.

The various components of the drilling system 100 may further include one or more sensors, gauges, pumps, compressors, and the like used store, monitor, regulate, convey, and/or recondition the exemplary muds 122. While not specifically illustrated, the disclosed drilling system 100 may include drill collars, mud motors, downhole mud motors, and/or pumps associated with the drill string 108, measurement while drilling (MWD), wireline and/or logging while drilling (LWD) tools and related telemetry equipment, sensors or distributed sensors associated with the drill string 108, downhole heat exchangers, valves and corresponding actuation devices, tool seals, packers and other wellbore isolation devices or components, and the like. The drilling assembly 100 may further include a control system 138 communicably coupled to various components of the drilling system 100 (e.g., the mixing hopper 134, a downhole mud motor, the pump 120, sensors, and the like) and be capable of executing the mathematical algorithms, methods, and drilling control.

The drilling system 100 may include a conventionally located pulsation dampener 123 at the outlet of the mud pump 120. Fluid pump or mud pump 120 may pump fluid or mud from a mud pit 132 through pulsation dampener 123 and feed pipe 124 in the direction of a derrick 104. More than one mud pump can be utilized in the drilling system 100 to continue drilling upon the failure of a single mud pump 120. Conventionally, a pulsation dampener can be installed on the discharge line for each mud pump to reduce pumped fluid pressure pulsations.

The drilling system 100 of the present disclosure also includes an agitator 142 of the type discussed above, typically used to complete directional (e.g., horizontal or slanted) drilling and often when going into a turn from a vertical portion of the borehole to a directional portion. The agitator shakes the drill pipe within the drill string, to promote mud flow and to reduce the likelihood of the drill string getting stuck and potentially to improve penetration rates while drilling. The agitator 142 may operate by inducing pressure pulses within the mud flow, which pressure pulses can affect the surface equipment. Agitators use the pumped drilling mud flow rates and pressures to create a rhythmic pulse with a pulsation frequency associated with the rotational rotor speed within the stator housing and, to some degree, with the pumped fluid flow rate and a pulsation intensity associated with the pumped fluid pressure. The vibrations or pulsations not only shake the pipe within the drill string 108, but also travel upwards inside the drill pipe to the surface. where the vibrations shake the top drive, cabling, hoses, lights and at times even the derrick. Some of these forces can be quite significant at times.

The present disclosure relates to such pumped fluid pressure pulsations induced within the fluid down the drill string 108 from sources other than the mud pump 120, and particularly to reducing the pumped fluid pulsation effects and interaction coming from a downhole agitator 142. In drilling systems, pulsation dampening device(s)—often in a configuration including a traditional pulsation dampener at the pump outlet and a suction stabilizer at the pump inlet (not shown)—can be installed near the mud pump 120 to reduce pump loads and minimize pumped fluid pulsation amplitudes from the mud pump 120. Typically, such pulsation dampening device(s) are sized or configured based on characteristics of the mud pump 120, not based on the drilling system as a whole. Recent proposals observe that, since fluid from multiple pumps may be combined at a standpipe manifold (not shown in FIG. 1, but located between the mud pump 120 and standpipe 125) into a single stream and sent to the standpipe 125, significant energy and pulsation amplitudes may be created by the combining of the streams from the various mud pumps and transferred directly to the standpipe 125, which is then transferred to the rest of the system downstream. The pulsation amplitudes produced may become greater as more mud pumps are used to provide fluid reaching the standpipe manifold, as pulsations from multiple pipes receiving fluid from multiple mud pumps come together and accumulate at the standpipe manifold (not shown), which are then transferred to the standpipe 125. These pulsations can cause wear and damage to components, including the connections near the swivel and top drive (or Kelly) and other components such as a wash pipe and wash pipe packing (seals) (both not shown) that serves as a conduit for fluid through the swivel and top drive. Instruments used for monitoring and measuring operations while drilling can also be affected by the residual pulsations from the mud pump(s). Even the smallest pulsations from the standpipe manifold can affect the measurement readings. These recent proposals thus suggest including pulsation dampening device(s) between the standpipe manifold and the swivel/top drive. An additional, "system" pulsation dampener is thus installed anywhere between the standpipe manifold and the standpipe 125, within the standpipe 125, between the standpipe 125 and the rotary hose 127, or between the rotary hose 127 and the swivel/top drive, to reduce residual pulsations from the mud pump 120 and to reduce pulsations from combining of fluid streams at the standpipe manifold. "System" pulsation dampening device(s) reduce the pulsations and, like the conventional pulsation dampener 123, may produce an internal or external pressure drop within the passing fluid in order to further reduced higher frequency pulsations and enhance the overall dampening performance. In some embodiments, the system pulsation dampener may be an appendage-type gas charged dampener (a hydro-pneumatic or gas-charged pressure vessel containing compressed air or nitrogen and a bladder or bellows that separates the process fluid from the gas charge), or a ball-type or cylindrical-type flow-through dampener that relies on compressibility of either an elastomeric material or the process fluid contained within dampener enclosure and/or a flow-resistance (or "orifice") device fitted with or into the pulsation dampener to dampen pump pulsations.

The present disclosure includes pulsation dampening device(s) 139, 140, and/or 150 within or connected to the drill string 108 to reduce both low and high frequency pulsation magnitudes and allow the wash pipe and packing, bottom hole assembly 152, and as well as other components to last longer. Such pulsation dampening device(s) 139, 140, and 150 may be specifically configured to attenuate pressure pulsations induced by an agitator 142 within the drilling tools. The bottom hole assembly is the lowest part of the drill, attached to the end of a drill string and typically consisting of the drill bit with collars that add weight and thus increase the force of the drilling action, as well as high tech equipment to monitor the drilling and set the direction of the drill. Alternatively, a bottom hole assembly can be quite basic in design, consisting only of a drill bit, crossovers and collars. The bottom hole assembly may also be more advanced, consisting of additional components like a mud motor and directional drilling and measuring equipment. Fluid (mud) is pumped through the bottom hole assembly to remove the debris as the drill bit cuts through the surface. Direction of drilling can be controlled through the assembly (steerables), which is attached via a drill string to the surface of the well. The bottom hole assembly is thus an important active component of drilling equipment used to create a well.

In addition, the drill string pulsation dampening device(s) 139, 140, and 150 reduce noise and pulsation levels to allow for easier signal detection by an MWD and/or LWD contractor located on the drilling platform 102. The pulsation dampening device(s) 139, 140, and 150 assist with reducing interference with downhole instruments that may pick up the residual pulsations and that skew detections and generated data from the downhole instruments. Whereas the "system" pulsation dampener device(s) are located between the standpipe 125 and the top drive (i.e., locations upstream of the top drive), the pulsation dampening device(s) 139, 140, and 150 are located downstream of the top drive, to reduce the shaking forces by disrupting the agitator pulsation levels.

In some embodiments of the present disclosure, a top drive pulsation dampening device may be formed by integrating a disruptive feature into the top drive, which has an upper connection to a feed source (e.g., a Kelly hose) and a lower connection via either a "modified saver sub," or an uppermost drill pipe segment within the drill string 108, located above and/or below the bottom hole assembly 152.

In some drilling assemblies, a "saver sub" fits between the uppermost drill pipe segment within the drill string 108 and the lower Kelly valve (iBOP) 110 connected to the top drive suspended from the traveling block 106 and swivel 107, to protect the lower Kelly valve, and/or the top drive's pipe thread from wear due to the repeated high number of connection and disconnection actions associated with adding or removing drill pipe. The saver sub becomes a sacrificial part in case of thread damage. In some embodiments of the present disclosure, a saver sub pulsation dampening device 139 may be formed by locating a disruptive feature inside the saver sub, with an upper threaded connection to the top drive and a lower threaded connection to the uppermost drill pipe segment within the drill string 108. In some embodiments, a pulsation dampening device 139 may be formed within a body that is either connected in place of the saver sub, with an upper connection to the top drive or top drive lower Kelly valve 110 and a lower connection to the uppermost drill pipe segment within the drill string 108, or connected below the saver sub, with an upper connection to the saver sub and a lower connection to the uppermost drill pipe segment within the drill string 108.

Either integrating the pulsation dampening device disruptive feature within the saver sub or in a body connected to the saver sub are locations (i.e., just below or near the top drive) making inspection and replacement very easy. However, such locations may not be as effective as locating a drill string pulsation dampening device 140 or 150 downhole at a single or even multiple locations, putting the drill string pulsation dampening device(s) closer to the originating energy (e.g., the agitator 152). More than one drill string pulsation dampening device(s) may ultimately be more suitable for removing the maximum energy possible. It may be important to also consider placement of a drill string pulsation dampening device 150 below the agitator 142 as protection for the bottom hole assembly 152 from damage caused by the agitator 142.

In general, pulsation dampening device(s) 139, 140, and 150 include a disruptive feature attenuating fluid pulsation or acoustic energy. In some embodiments, the disruptive feature is an orifice providing square or "sharp" edges to the fluid flow path followed by a relief feature increasing the cross-sectional area of the fluid flow path relative to that provided by the orifice. The square or sharp edges of the orifice may face the direction of origin for fluid pulsation or acoustic energy to be attenuated—that is, downhole for pulsations originating with the agitator. The disruptive features may be unidirectional, with square or "sharp" edges facing only upstream or downstream, or bidirectional, with square or "sharp" edges facing both upstream and downstream.

Figure 2A:
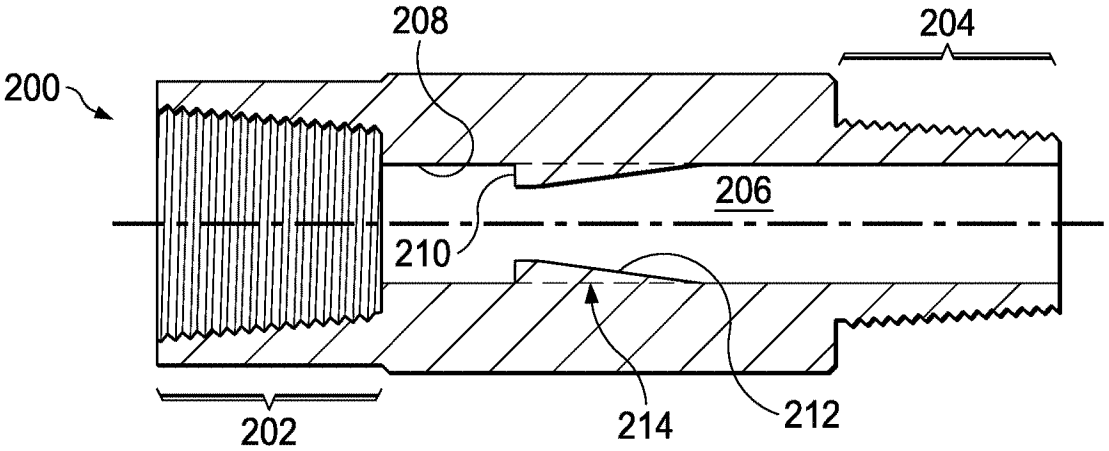
FIGS. 2 and 2A are end and cross-sectional views, respectively, of a single orifice, unidirectional saver sub or drill string pulsation dampening device according to embodiments of the present disclosure.
Figure 2:
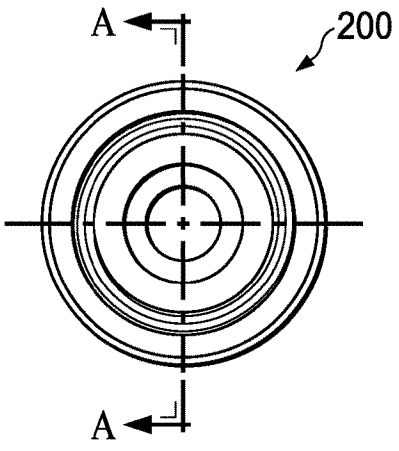

FIGS. 2 and 2A are end and cross-sectional views, respectively, of a single orifice, unidirectional saver sub or drill string pulsation dampening device according to embodiments of the present disclosure. FIG. 2A is a sectional view taken at line AA-AA in FIG. 2. The embodiment illustrated in FIGS. 2 and 2A is for illustration only. FIGS. 2 and 2A do not limit the scope of this disclosure to any particular implementation. This device may be oriented with the square edge facing downhole rather than as shown.

Pulsation dampening device 200 is suitable for use as either saver sub pulsation dampener device 139 or drill string pulsation dampening device 140 and 150. Pulsation dampening device 200 includes an upper connection end 202 receiving pumped fluid and having a female threaded connection and a lower connection end 204 discharging pumped fluid and having a male threaded connection. Pulsation dampening device 200 also includes an internal flow passage 206 that extends generally axially through the pulsation dampening device 200 from the upper connection end 202 to the lower connection end 204, through which pumped fluid flows predominantly in the direction 205 from the upper connection end 202 to the lower connection end 204. Other so called "Saver Sub Pulsation Dampening"

designs—including those depicted in the remaining figures and described below—may have male by male threaded ends (more commonly referred to as a "Pin X Pin Sub") or other male/female connection arrangements.

Figure 3A:
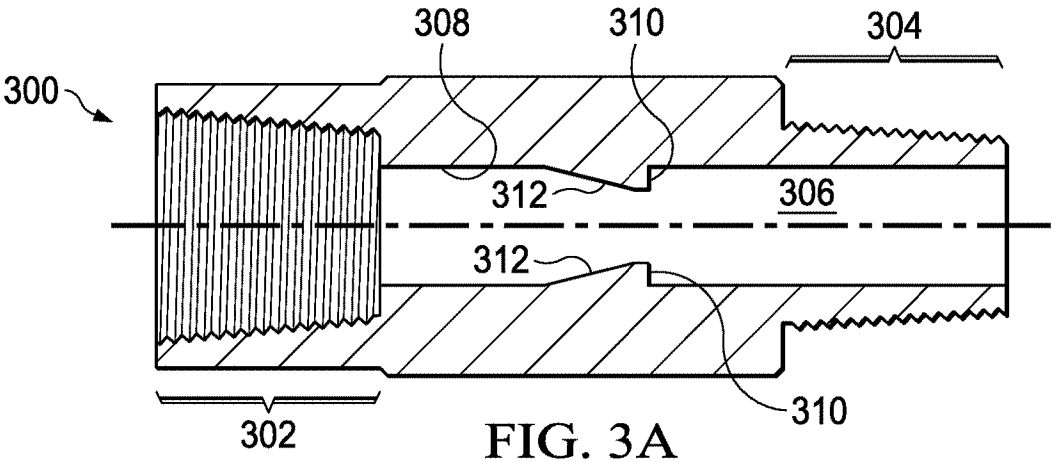
FIGS. 3 and 3A are end and cross-sectional views, respectively, of a single orifice, unidirectional pulsation dampening device, with the orifice feature facing the opposite direction of FIGS. 2 and 2A, according to embodiments of the present disclosure.
Figure 3:
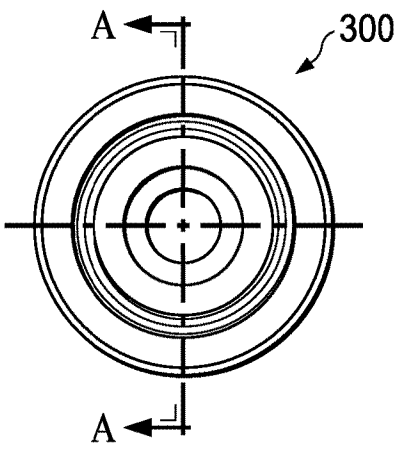

The internal flow passage 206 includes a throat 208, and orifice edge 210 and a relief feature 212. The "square edge" (or "sharp edge") pressure drop feature is disposed facing the source of the predominant fluid flow direction—that is, upstream. The features within internal flow passage 206—orifice edge 210 and tapered (shown) or abrupt (not shown) relief feature 212—may be permanent within (machined into) the internal flow passage 206, or may be replaceable as indicated by possible separation/replacement line 214. These surfaces may be steel, alloy steel, hardened steel or wear resistance coated steel. Similarly, the replacement option may be any of these materials as well as hard ceramic or other hard wear resistance material such as but not limited to tungsten carbide (solid or coated components), nitrided or 17-4 PH annealed stainless steel. The materials and/or surfaces of designs depicted in the remaining drawings and described below FIGS. 3 and 3A are end and cross-sectional views, respectively, of a single orifice, unidirectional pulsation dampening device according to embodiments of the present disclosure. FIG. 3A is a sectional view taken at line AB-AB in FIG. 3. The embodiment illustrated in FIGS. 3 and 3A is for illustration only. FIGS. 3 and 3A do not limit the scope of this disclosure to any particular implementation. This device has a square edge facing the opposite direction from that shown in FIG. 2A, but may be installed where the square edge faces downhole.

Pulsation dampening device 300 is suitable for use as either saver sub pulsation dampener device 139 or drill string pulsation dampening device 140, 150. Pulsation dampening device 300 includes an upper connection end 302 receiving pumped fluid and having a female threaded connection and a lower connection end 304 discharging pumped fluid and having a male threaded connection. Pulsation dampening device 300 also includes an internal flow passage 306 that extends generally axially through the pulsation dampening device 300 from the upper connection end 302 to the lower connection end 304, through which pumped fluid flows predominantly in the direction 305 from the upper connection end 302 to the lower connection end 304.

The internal flow passage 306 includes a throat 308, and orifice edges 310 and relief features 312. Both "square edge" pressure drop features are disposed facing the source of the predominant fluid flow direction—that is, upstream. The features within internal flow passage 306—orifice edges 310 and tapered (shown) or abrupt (not shown) relief features 312—may be permanent within (machined into) the internal flow passage 306, or may be replaceable.

Figure 4A:
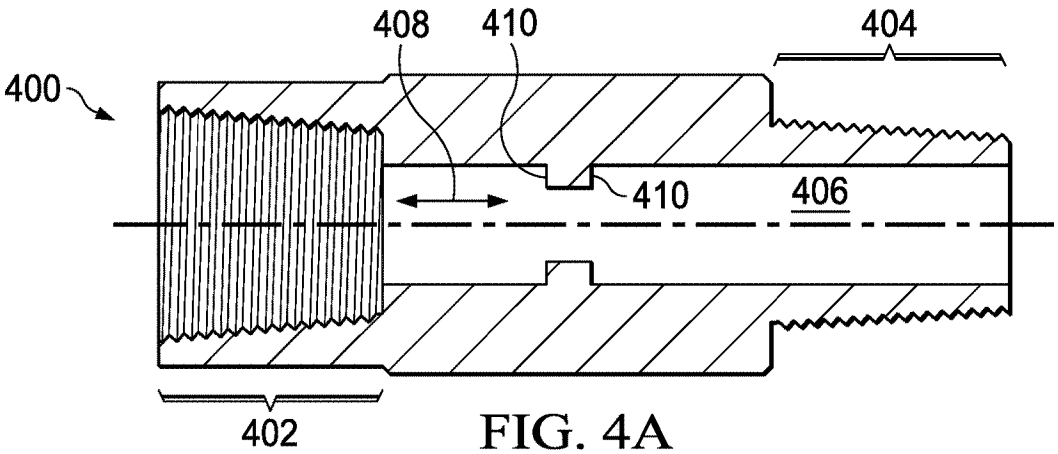
FIGS. 4 and 4A are end and cross-sectional views, respectively, of a single orifice, bidirectional pulsation dampening device according to embodiments of the present disclosure.
Figure 4:
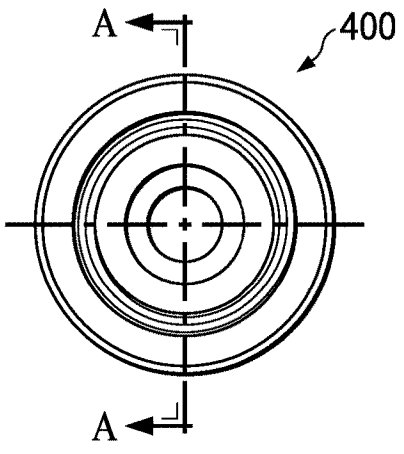

FIGS. 4 and 4A are end and cross-sectional views, respectively, of a single orifice, bidirectional pulsation dampening device according to embodiments of the present disclosure. FIG. 4A is a sectional view taken at line A-A in FIG. 4. The embodiment illustrated in FIGS. 4 and 4A is for illustration only. FIGS. 4 and 4A do not limit the scope of this disclosure to any particular implementation.

Pulsation dampening device 400 is suitable for installation for unidirectional or bidirectional use, and is suitable for use as either saver sub pulsation dampener device 139 or drill string pulsation dampening device 140 and/or 150. Pulsation dampening device 400 includes an upper connection end 402 receiving pumped fluid and having a female threaded connection and a lower connection end 404 discharging pumped fluid and having a male threaded connection. Pulsation dampening device 400 also includes an internal flow passage 406 that extends generally axially through the pulsation dampening device 400 from the upper connection end 402 to the lower connection end 404, through which pumped fluid flows predominantly from the upper connection end 402 to the lower connection end 404. Pulsation dampening device 400 is bidirectional, shown with fluid flow 408.

The internal flow passage 406 includes a throat created by two orifice edges 410. The "square edge" pressure drop features are disposed facing opposite directions—both the direction of the source of the predominant fluid flow direction (that is, upstream) and the opposite direction (downstream). The features within internal flow passage 406—orifice edges 410—may be permanent within (machined into) the internal flow passage 406, or may be replaceable.

In some embodiments of the foregoing or below described pulsation dampening devices, a wear resistant surface or element is located adjacent to the square or "sharp" edges facing downstream toward the agitator. In particular, for the embodiment of FIG. 4A, fluid flowing along the internal flow passage 406, before the first of the two orifice edges 410, and then across the square edge surface of the second of the two orifice edges 410, will create turbulence as that fluid flow exits the inner diameter of the second of the two orifice edges 410. That turbulence could possibly erode (fluid cut) the internal diameter immediately downstream of the second of the two orifice edges 410—that is, the inner diameter of a portion of the internal flow passage 406 adjacent to the second (downstream) orifice edge 410.

Figure 5A:
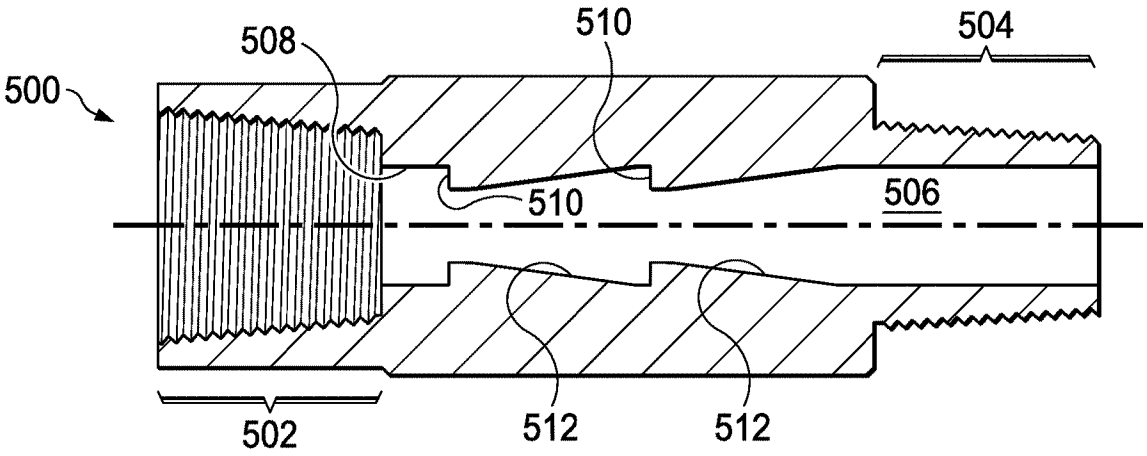
FIGS. 5 and 5A are end and cross-sectional views, respectively, of a dual orifice, unidirectional dampening device according to embodiments of the present disclosure.
Figure 5:
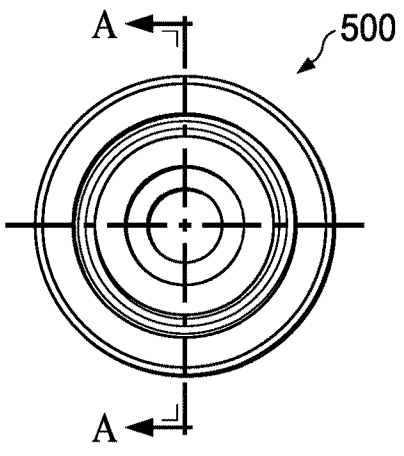

FIGS. 5 and 5A are end and cross-sectional views, respectively, of a dual orifice, unidirectional pulsation dampening device according to embodiments of the present disclosure. FIG. 5A is a sectional view taken at line A-A in FIG. 5. The embodiment illustrated in FIGS. 5 and 5A is for illustration only. FIGS. 5 and 5A do not limit the scope of this disclosure to any particular implementation. This device maybe installed where the square edges face downhole as shown, or with the opposite orientation.

Pulsation dampening device 500 is suitable for use as either saver sub pulsation dampener device 139 or drill string pulsation dampening device 140, 150. Pulsation dampening device 500 includes an upper connection end 502 receiving pumped fluid and having a female threaded connection and a lower connection end 504 discharging pumped fluid and having a male threaded connection. Pulsation dampening device 500 also includes an internal flow passage 506 that extends generally axially through the pulsation dampening device 500 from the upper connection end 502 to the lower connection end 504, through which pumped fluid flows predominantly in the direction from the upper connection end 502 to the lower connection end 504.

The internal flow passage 506 includes a throat 508, and square orifice edges 510 and relief features 512. Both "square edge" pressure drop features are disposed facing the source of the predominant fluid flow direction—that is, upstream. The features within internal flow passage 506—orifice edges 510 and tapered (shown) or abrupt (not shown) relief features 512—may be permanent within (machined into) the internal flow passage 506, or may be replaceable.

Figure 6A:
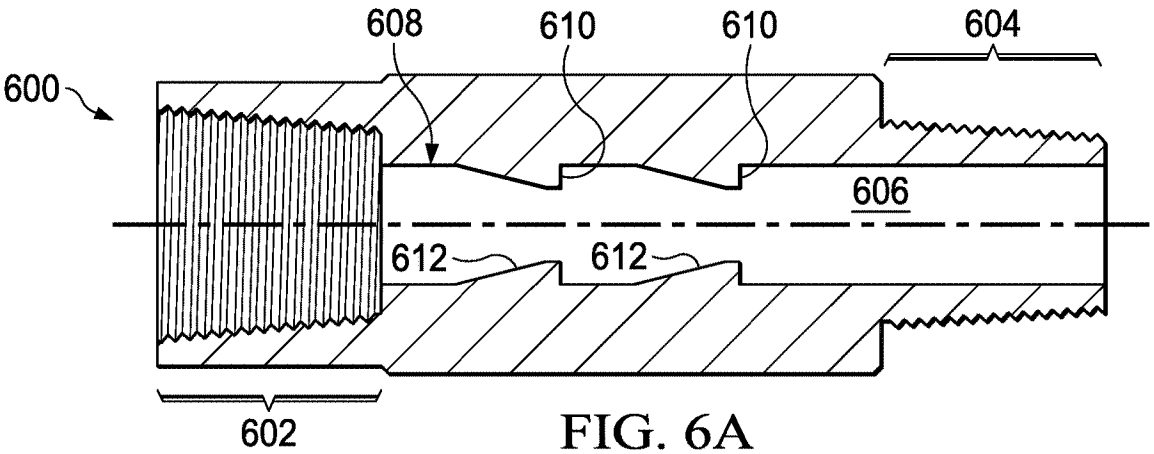
FIGS. 6 and 6A are end and cross-sectional views, respectively, of a dual orifice, unidirectional pulsation dampening device, with the orifice feature facing the opposite direction of FIGS. 5 and 5A, according to embodiments of the present disclosure.
Figure 6:
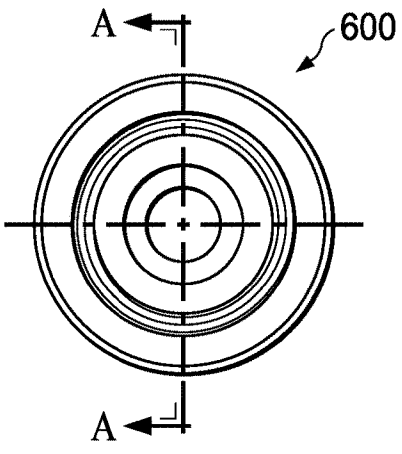

FIGS. 6 and 6A are end and cross-sectional views, respectively, of a dual orifice, unidirectional pulsation dampening device according to embodiments of the present disclosure. FIG. 6A is a sectional view taken at line A-A in FIG. 6. The embodiment illustrated in FIGS. 6 and 6A is for illustration only. FIGS. 6 and 6A do not limit the scope of this disclosure to any particular implementation. This device has square edges facing the opposite direction from that shown in FIG. 5A, but maybe installed where the square edges face downhole.

Pulsation dampening device 600 is suitable for use as either saver sub pulsation dampener device 139 or drill string pulsation dampening device 140, 150. Pulsation dampening device 600 includes an upper connection end 602 receiving pumped fluid and having a female threaded connection and a lower connection end 604 discharging pumped fluid and having a male threaded connection. Pulsation dampening device 600 also includes an internal flow passage 606 that extends generally axially through the pulsation dampening device 600 from the upper connection end 602 to the lower connection end 604, through which pumped fluid flows predominantly in the direction from the upper connection end 602 to the lower connection end 604.

The internal flow passage 606 includes a throat 608, and square orifice edges 610 and sloped relief features 612. Both "square edge" pressure drop features are disposed facing opposite to the source of the predominant fluid flow direction—that is, downstream. The features within internal flow passage 606—orifice edges 610 and relief features 612—may be permanent within (machined into) the internal flow passage 606, or may be replaceable.

Figure 7A:
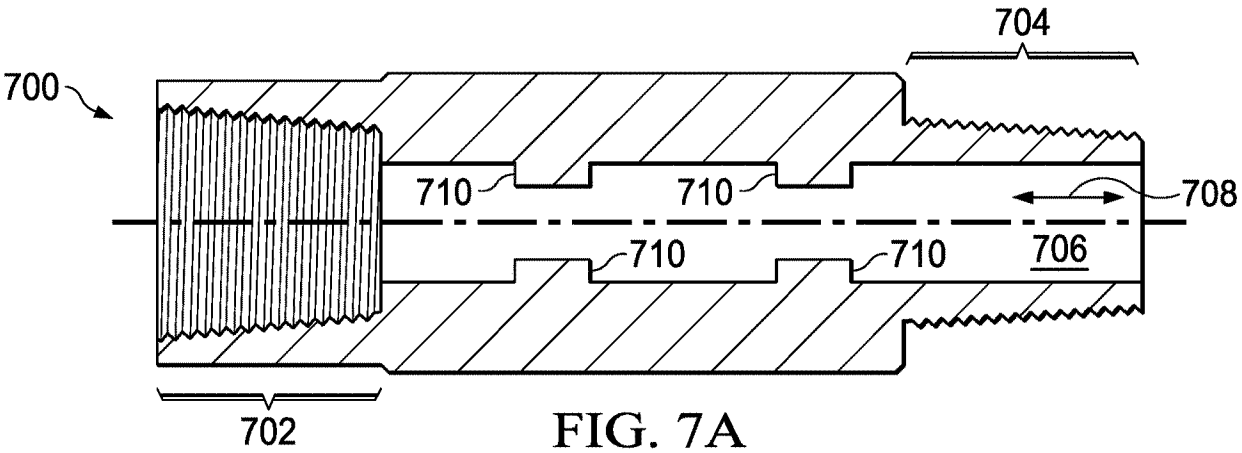
FIGS. 7 and 7A are end and cross-sectional views, respectively, of a multiple orifice, bidirectional pulsation dampening device according to embodiments of the present disclosure.
Figure 7:
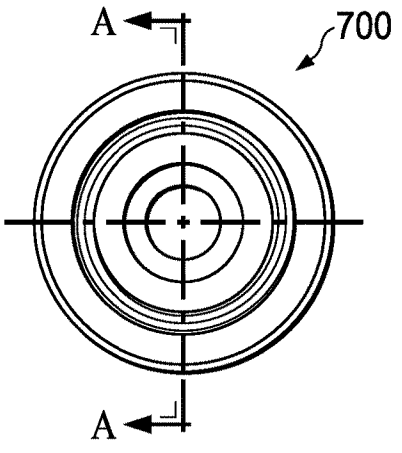

FIGS. 7 and 7A are end and cross-sectional views, respectively, of a multiple orifice, bidirectional pulsation dampening device according to embodiments of the present disclosure. FIG. 7A is a sectional view taken at line A-A in FIG. 7. The embodiment illustrated in FIGS. 7 and 7A is for illustration only. FIGS. 7 and 7A do not limit the scope of this disclosure to any particular implementation.

Pulsation dampening device 700 is suitable for installation for either unidirectional or bidirectional use, and is suitable for use as either saver sub pulsation dampener device 139 or drill string pulsation dampening device 140 and/or 150. Pulsation dampening device 700 includes an upper connection end 702 receiving pumped fluid and having a female threaded connection and a lower connection end 704 discharging pumped fluid and having a male threaded connection. Pulsation dampening device 700 also includes an internal flow passage 706 that extends generally axially through the pulsation dampening device 700 from the upper connection end 702 to the lower connection end 704, through which pumped fluid flows predominantly from the upper connection end 702 to the lower connection end 704. Pulsation dampening device 700 is bidirectional, shown with fluid flow 708.

The internal flow passage 706 includes two throats created by four orifice edges 710 (on each side). The "square edge" pressure drop features are disposed facing opposite directions—both the direction of the source of the predominant fluid flow direction (that is, upstream) and the opposite direction (downstream). The features within internal flow passage 706—orifice edges 710—may be permanent within (machined into) the internal flow passage 706, or may be replaceable.

Figure 8A:
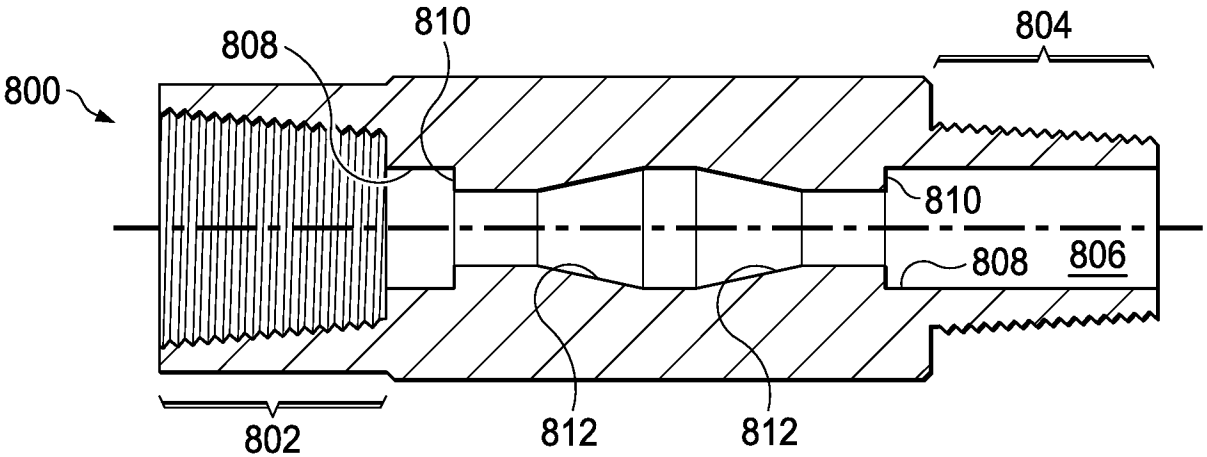
FIGS. 8 and 8A are end and cross-sectional views, respectively, of a multiple orifice, bidirectional pulsation dampening device according to embodiments of the present disclosure.
Figure 8:
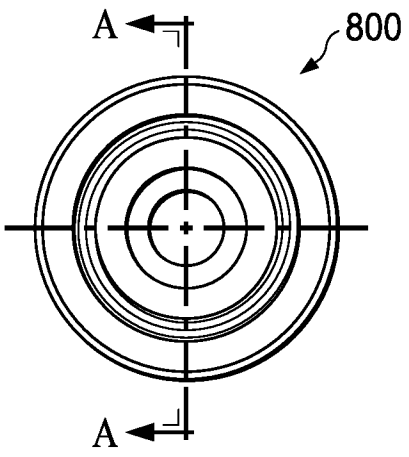

FIGS. 8 and 8A are end and cross-sectional views, respectively, of a dual orifice, bidirectional pulsation dampening device according to embodiments of the present disclosure. FIG. 8A is a sectional view taken at line A-A in FIG. 8. The embodiment illustrated in FIGS. 8 and 8A is for illustration only. FIGS. 8 and 8A do not limit the scope of this disclosure to any particular implementation.

Pulsation dampening device 800 is suitable for use as either saver sub pulsation dampener device 139 or drill string pulsation dampening device 140 and/or 150. Pulsation dampening device 800 includes an upper connection end 802 receiving pumped fluid and having a female threaded connection and a lower connection end 804 discharging pumped fluid and having a male threaded connection. Pulsation dampening device 800 also includes an internal flow passage 806 that extends generally axially through the pulsation dampening device 800 from the upper connection end 802 to the lower connection end 804, through which pumped fluid flows predominantly from the upper connection end 802 to the lower connection end 804.

The internal flow passage 806 includes two throats 808, and two orifice edges 810 and a relief feature 812. The "square edge" pressure drop features are disposed facing opposite directions—both the direction of the source of the predominant fluid flow direction (that is, upstream) and the opposite direction (downstream). The features within internal flow passage 806—orifice edges 810 and relief feature 812—may be permanent within (machined into) the internal flow passage 806, or may be replaceable.

Figure 9A:
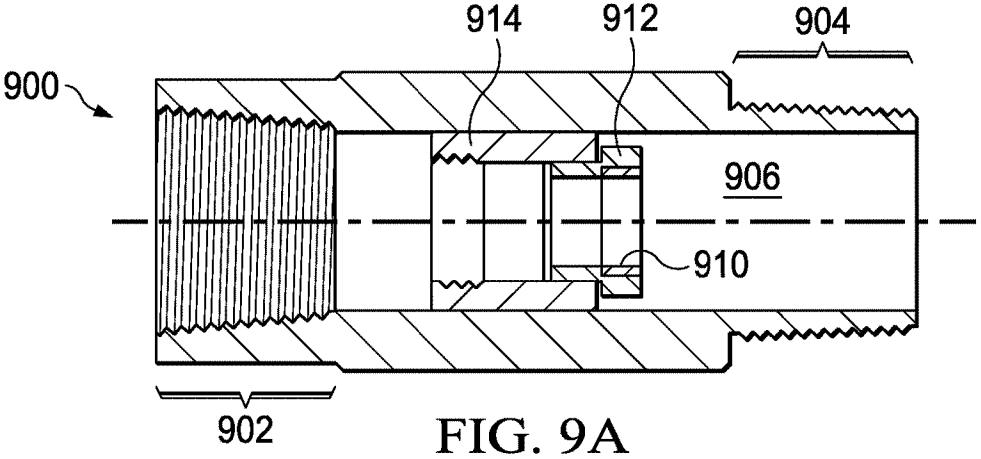
FIGS. 9 and 9A are end and cross-sectional views, respectively, of a threaded insert unidirectional pulsation dampening device according to embodiments of the present disclosure.
Figure 9:
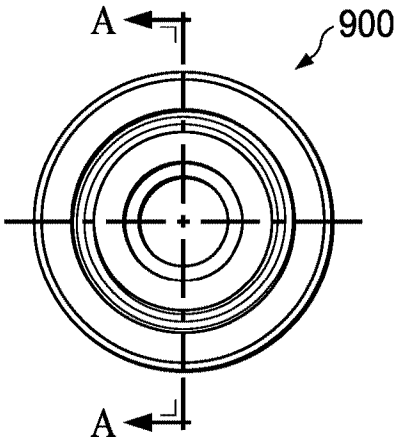

FIGS. 9 and 9A are end and cross-sectional views, respectively, of a threaded insert unidirectional pulsation dampening device according to embodiments of the present disclosure. FIG. 9A is a sectional view taken at line A-A in FIG. 9. The embodiment illustrated in FIGS. 9 and 9A is for illustration only. FIGS. 9 and 9A do not limit the scope of this disclosure to any particular implementation. This device maybe installed where the square edge faces downhole.

Pulsation dampening device 900 is suitable for use as either saver sub pulsation dampener device 139 or drill string pulsation dampening device 140 and 150. Pulsation dampening device 900 includes an upper connection end 902 receiving pumped fluid and having a female threaded connection and a lower connection end 904 discharging pumped fluid and having a male threaded connection. Pulsation dampening device 900 also includes an internal flow passage 906 that extends generally axially through the pulsation dampening device 900 from the upper connection end 902 to the lower connection end 904, through which pumped fluid flows predominantly from the upper connection end 902 to the lower connection end 904. This may be installed in the other direction where the square edge faces downhole.

Flow restriction inside pulsation dampening device 900 is provided by an orifice assembly including an annular ceramic insert 910 that is received in a portion of a hex nut 912, which is partially received by and abuts an annular coupler 914. The coupler 914 may be welded, glued, or interference fit into the interior of the pulsation dampening device 900, or alternatively may be machined into the inner diameter during machine fabrication of the pulsation dampening device 900. The body the coupler 914 has an axial through-hole with female threading along at least a portion thereof. In the example shown, the end portions of the axial through-hole have a larger diameter than a central portion, and each of those end portions has internal threads. The hex nut 912 may be screwed into the coupler 914, and the ceramic insert 910 (a high wear resistant orifice) may be glued or interference fit into the hex nut 912, making the hex nut 912 and the ceramic (wear) insert 910 easily replaceable as necessitated by wear of the ceramic insert 910. Each of hex nut 912 and ceramic insert 910 abuts a shoulder in the respective receiving structure to keep from being pushed out by fluid flow. This orifice assembly design produces a stronger part and a more reliable orifice feature. The orifice assembly depicted in FIGS. 9 and 9A may be oriented in the opposite direction within the body of the pulsation dampening device 900.

Figure 10A:
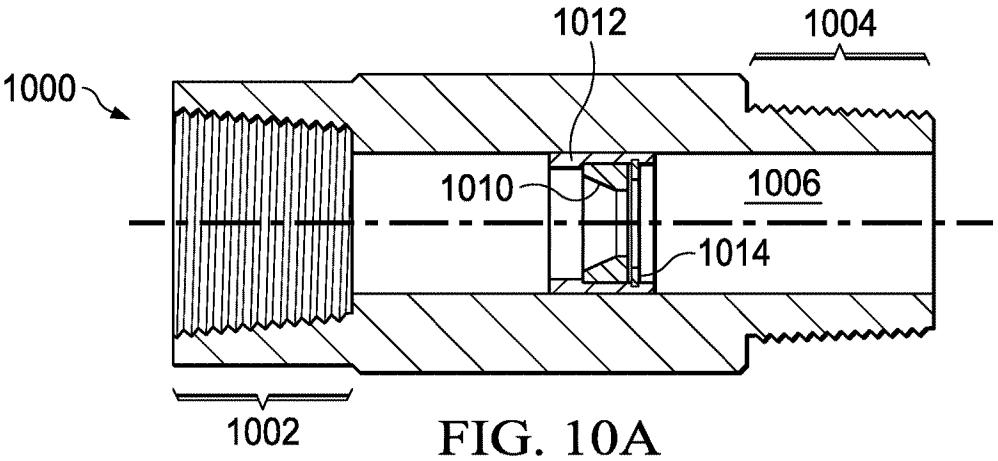
FIGS. 10 and 10A are end and cross-sectional views, respectively, of a seal ring insert string unidirectional pulsation dampening device according to embodiments of the present disclosure.
Figure 10:
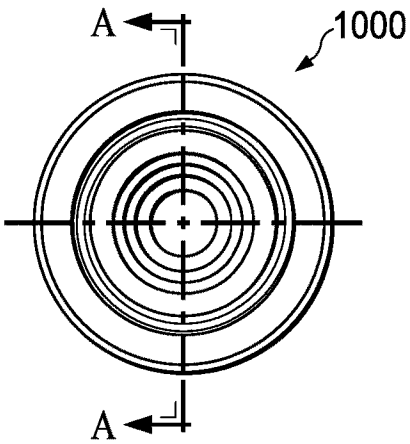

FIGS. 10 and 10A are end and cross-sectional views, respectively, of a seal ring insert unidirectional pulsation dampening device according to embodiments of the present disclosure. FIG. 10A is a sectional view taken at line A-A in FIG. 10. The embodiment illustrated in FIGS. 10 and 10A is for illustration only. FIGS. 10 and 10A do not limit the scope of this disclosure to any particular implementation. This device maybe installed where the square edge faces downhole.

Pulsation dampening device 1000 is suitable for use as either saver sub pulsation dampener device 139 or drill string pulsation dampening device 140 and 150. Pulsation dampening device 1000 includes an upper connection end 1002 receiving pumped fluid and having a female threaded connection and a lower connection end 1004 discharging pumped fluid and having a male threaded connection. Pulsation dampening device 1000 also includes an internal flow passage 1006 that extends generally axially through the pulsation dampening device 1000 from the upper connection end 1002 to the lower connection end 1004, through which pumped fluid flows predominantly from the upper connection end 1002 to the lower connection end 1004.

Flow restriction in pulsation dampening device 1000 is provided by a reversible orifice assembly structure that includes orifice plate 1010, retainer sleeve 1012, and retaining snap ring 1014. Retainer sleeve 1012 is glued, welded, interference fit, or screwed into place within the interior of pulsation dampening device 1000. Orifice plate 1010 is cylindrical with an axial through-hole that has a tapered portion, wider at one end of the orifice plate 1010, leading into a cylindrical opening at the other end of the orifice plate 1010. Orifice plate 1010 is receive within an axial cylindrical annulus through the retainer sleeve 1012, with the annulus being smaller that the orifice plate 1010 at one end to form a shoulder against which the orifice plate 1010 abuts. The retaining ring 1014 is a compressible, incomplete annular disk that is also received within the annulus through retainer sleeve 1012 and expands into an interior groove in the retainer sleeve 1012 to hold the orifice plate 1010 against the shoulder formed by the narrow portion of the annulus. This structure simplifies replacement of the orifice plate 1010 when necessitated by wear, or when an orifice plate with a different taper is needed due to different flow characteristics.

Figure 11A:
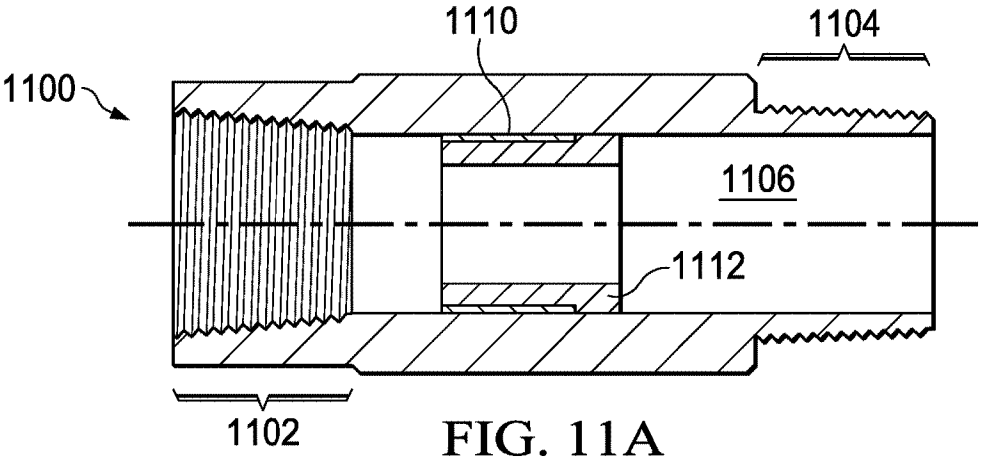
FIGS. 11 and 11A are end and cross-sectional views, respectively, of an annular insert unidirectional pulsation dampening device according to embodiments of the present disclosure.
Figure 11:
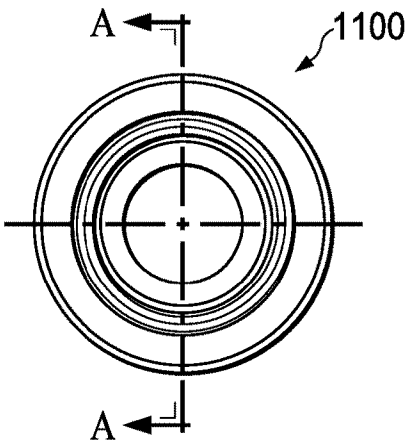

FIGS. 11 and 11A are end and cross-sectional views, respectively, of an annular insert unidirectional pulsation dampening device according to embodiments of the present disclosure. FIG. 11A is a sectional view taken at line A-A in FIG. 11. The embodiment illustrated in FIGS. 11 and 11A is for illustration only. FIGS. 11 and 11A do not limit the scope of this disclosure to any particular implementation. This device maybe installed where the square edge faces downhole.

Pulsation dampening device 1100 is suitable for use as either saver sub pulsation dampener device 139 or drill string pulsation dampening device 140 and 150. Pulsation dampening device 1100 includes an upper connection end 1102 receiving pumped fluid and having a female threaded connection and a lower connection end 1104 discharging pumped fluid and having a male threaded connection. Pulsation dampening device 1100 also includes an internal flow passage 1106 that extends generally axially through the pulsation dampening device 1100 from the upper connection end 1102 to the lower connection end 1104, through which pumped fluid flows predominantly from the upper connection end 1102 to the lower connection end 1104.

Inside the pulsation dampening device 1100, flow restriction is provided by (in the example shown) an orifice assembly including an annular collar 1110 and a wear insert 1112. The orifice assembly is secured in position by welding a straight sleeve collar 1110 (akin to a backing ring, but designed to provide a shoulder for the wear insert 1112) in place, and a high wear resistant orifice insert 1112 is inserted inside the collar 1110, optionally retained in place by glue. As shown, the wear insert 1112 abuts a shoulder of the collar 1110 to keep the wear insert 1112 from being pushed out by fluid flow. The insert 1112 thus includes a portion that is received by the collar 1110 and that is internally annular, to create a pressure drop attenuating fluid pressure pulses. Of course, the orifice assembly may be oriented in the opposite direction within the body of the pulsation dampening device 1100 for fluid flow in the opposite direction. The portion of the insert 1112 that is not received by the collar 1110 abuts the collar 1110, and the insert 1112 is preferably made of a wear-resistant material. Using known flow restriction pulsation dampening techniques, the inside diameter of the annulus within insert 1112 of pulsation dampening device 1100 may optionally be optimized for specific drilling conditions, including agitator shock tool-induced fluid pressure pulsation frequency and intensity. As a result of the flow restriction, pulsation dampening device 1100 protects surface equipment from pulsation energies generated by the agitator within the drill string, as well as shock tools generating fluid pressure pulses.

Figure 12A:
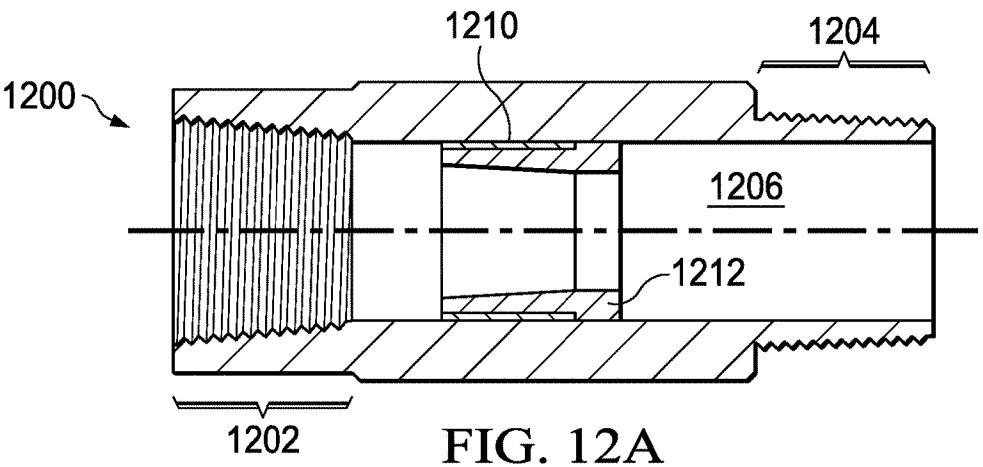
FIGS. 12 and 12A are end and cross-sectional views, respectively, of a taper insert pulsation dampening device according to embodiments of the present disclosure.
Figure 12:
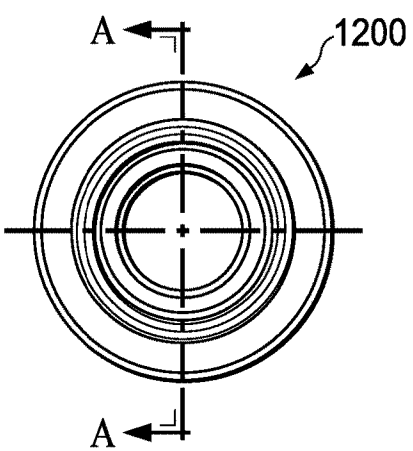

FIGS. 12 and 12A are end and cross-sectional views, respectively, of a taper insert unidirectional pulsation dampening device according to embodiments of the present disclosure. FIG. 12A is a sectional view taken at line A-A in FIG. 12. The embodiment illustrated in FIGS. 12 and 12A is for illustration only. FIGS. 12 and 12A do not limit the scope of this disclosure to any particular implementation. This device maybe installed where the square edge faces downhole.

Pulsation dampening device 1200 is suitable for use as either saver sub pulsation dampener device 139 or drill string pulsation dampening device 140 and/or 150. Pulsation dampening device 1200 includes an upper connection end 1202 receiving pumped fluid and having a female threaded connection and a lower connection end 1204 discharging pumped fluid and having a male threaded connection. Pulsation dampening device 1200 also includes an internal flow passage 1206 that extends generally axially through the pulsation dampening device 1200 from the upper connection end 1202 to the lower connection end 1204, through which pumped fluid flows predominantly from the upper connection end 1202 to the lower connection end 1204.

Inside the pulsation dampening device 1200, flow restriction is provided by (in the example shown in FIG. 12A) an orifice assembly including an annular collar 1210 and a wear insert 1212. The orifice assembly is secured in position by welding a straight sleeve collar 1210 (akin to a backing ring, but designed to provide a shoulder for the wear insert 1212) in place, and a high wear resistant orifice insert 1212 is inserted inside the collar 1210, optionally retained in place by glue or interference ft. As shown, the wear insert 1212 abuts a shoulder of the collar 1210 to keep the wear insert 1212 from being pushed out by fluid flow. The insert 1212 thus includes a portion that is received by the collar 1210 and that is tapered internally (widening in the direction of fluid flow), to create a pressure drop attenuating fluid pressure pulses. Of course, the orifice assembly may be oriented in the opposite direction within the body of the pulsation dampening device 1200 for fluid flow in the opposite direction. The portion of the insert 1212 that is not received by the collar 1210 abuts the collar 1210, and the insert 1212 is preferably made of a wear-resistant material. Using known flow restriction pulsation dampening techniques, the inside diameter and taper of insert 1212 within pulsation dampening device 1200 may optionally be optimized for specific drilling conditions, including agitator-induced fluid pressure pulsation frequency and intensity. As a result of the flow restriction, pulsation dampening device 1200 protects surface equipment from pulsation energies generated by the agitator within the drill string, as well as shock tools generating fluid pressure pulses.

Inside the unibody pulsation dampening device 1200, flow restriction is provided by an orifice machined from the parent body (4145 HT materials) and internally coated with abrasion/corrosion resistant materials such as tunsten carbide (e.g., "TnC"), cobalt-chromium alloy (e.g., Stellite), nitride, high chromium ("High Chrome") steel, 17-4 PH stainless steel or similar materials. This unibody design is non repairable and once eroded or corroded, will be replaced with a new unibody pulsation dampening device. Of course, the orifice may be oriented in the opposite direction within the unibody pulsation dampening device 800 for fluid flow in the opposite direction. Using known flow restriction pulsation dampening techniques, the inside diameter and taper within unibody pulsation dampening device 800 may optionally be optimized for specific drilling conditions, including agitator-induced fluid pressure pulsation frequency and intensity. Two options are thus available as a "regular" or "long life" sub with internal coatings or hardened materials used to combat erosion/corrosion.

Figure 13:
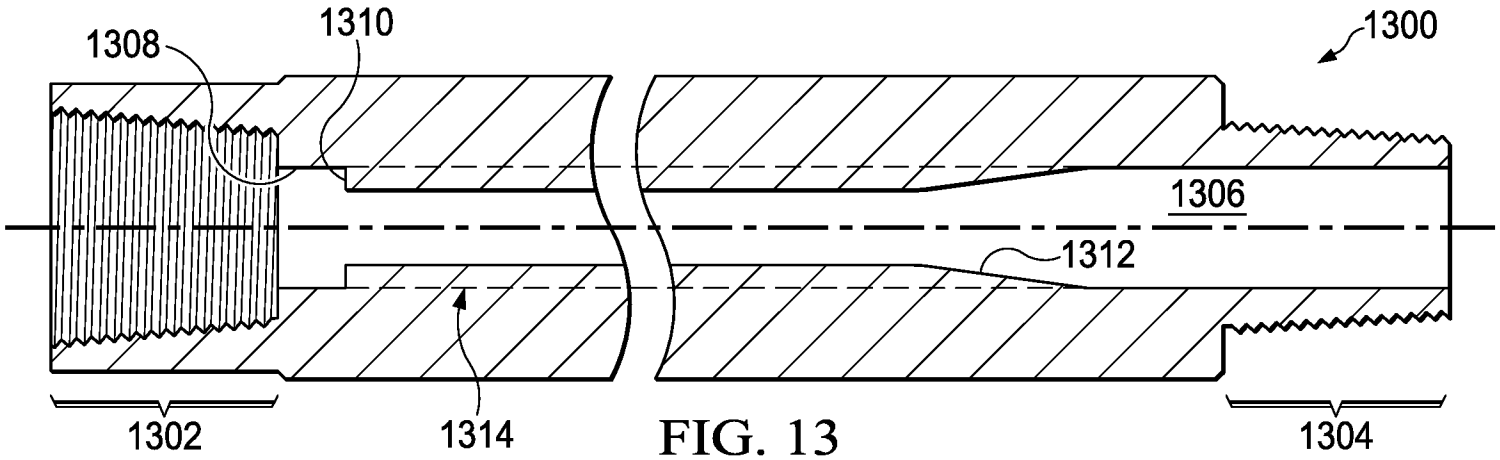
FIG. 13 is a cross-sectional view of a single orifice, unidirectional drill string pulsation dampening device according to embodiments of the present disclosure.

FIG. 13 is a cross-sectional view of a single orifice, unidirectional drill string pulsation dampening device according to embodiments of the present disclosure. The embodiment illustrated in FIG. 13 is for illustration only. FIG. 13 does not limit the scope of this disclosure to any particular implementation. This device maybe designed and installed where the square edge faces downhole.

Pulsation dampening device 1300 is suitable for use as either saver sub pulsation dampener device 139 or drill string pulsation dampening device 140 and/or 150. Pulsation dampening device 1300 includes an upper connection end 1302 receiving pumped fluid and having a female threaded connection and a lower connection end 1304 discharging pumped fluid and having a male threaded connection. Pulsation dampening device 1300 also includes an internal flow passage 1306 that extends generally axially through the pulsation dampening device 1300 from the upper connection end 1302 to the lower connection end 1304, through which pumped fluid flows predominantly from the upper connection end 1302 to the lower connection end 1304.

The internal flow passage 1306 includes a throat 1308, an orifice edge 1310, and a tapered relief feature 1312. The "square edge" pressure drop feature is disposed facing the source of the predominant fluid flow direction (upstream). The features within internal flow passage 1306—orifice edge 1310 and relief feature 1312—may be permanent within (machined into) the internal flow passage 1306, or may be replaceable as indicated by possible separation/replacement line 1314.

FIG. 13 illustrates an elongated orifice effect relative to FIG. 2A (although pulsation dampening device 1300 has a similar end view to that shown in FIG. 2). While the length of saver sub pulsation dampener device 139 or drill string pulsation dampening device 140 and 150 may normally be a short distance, substantially shorter than a drill pipe segment, the length of the orifice inner diameter within the internal flow passage may alternatively be lengthened to better effect the waveform of the pulsation energy, and may extend nearly the entire length of a one segment of drill pipe (about 30 feet) as represented by the break lines.

Figure 14:
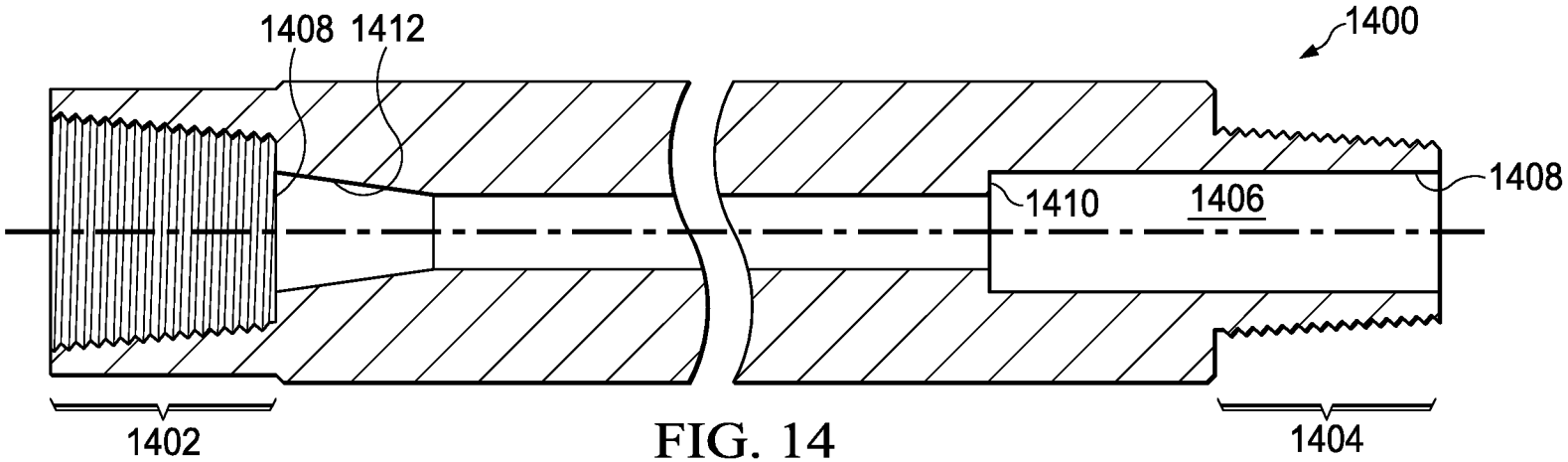
FIG. 14 is a cross-sectional view of a single orifice, unidirectional drill string pulsation dampening device according to embodiments of the present disclosure.

FIG. 14 is a cross-sectional view of a single orifice, unidirectional drill string pulsation dampening device according to embodiments of the present disclosure. The embodiment illustrated in FIG. 14 is for illustration only. FIG. 14 does not limit the scope of this disclosure to any particular implementation. This device has a square edge facing the opposite direction from that shown in FIG. 13, but may be installed where the square edge faces downhole.

Pulsation dampening device 1400 is suitable for use as either saver sub pulsation dampener device 139 or drill string pulsation dampening device 140 and 150. Pulsation dampening device 1400 includes an upper connection end 1402 receiving pumped fluid and having a female threaded connection and a lower connection end 1404 discharging pumped fluid and having a male threaded connection. Pulsation dampening device 1400 also includes an internal flow passage 1406 that extends generally axially through the pulsation dampening device 1400 from the upper connection end 1402 to the lower connection end 1404, through which pumped fluid flows predominantly from the upper connection end 1402 to the lower connection end 1404.

The internal flow passage 1406 includes a throat 1408, an orifice edge 1410, and a tapered relief feature 1412. The "square edge" pressure drop feature is disposed facing the source of the predominant fluid flow direction (upstream). The features within internal flow passage 1406—orifice edge 1410 and relief feature 1412—may be permanent within (machined into) the internal flow passage 1406, or may be replaceable as indicated by possible separation/replacement line 1414.

FIG. 14 illustrates an elongated orifice effect relative to FIG. 3A (although pulsation dampening device 1400 has a similar end view to that shown in FIG. 3). While the length of saver sub pulsation dampener device 139 or drill string pulsation dampening device 140 and 150 may normally be a short distance, substantially shorter than a drill pipe segment, the length of the orifice inner diameter within the internal flow passage may alternatively be lengthened to better effect the waveform of the pulsation energy, and may extend nearly the entire length of a one segment of drill pipe (about 30 feet) as represented by the break lines.

Figure 15:
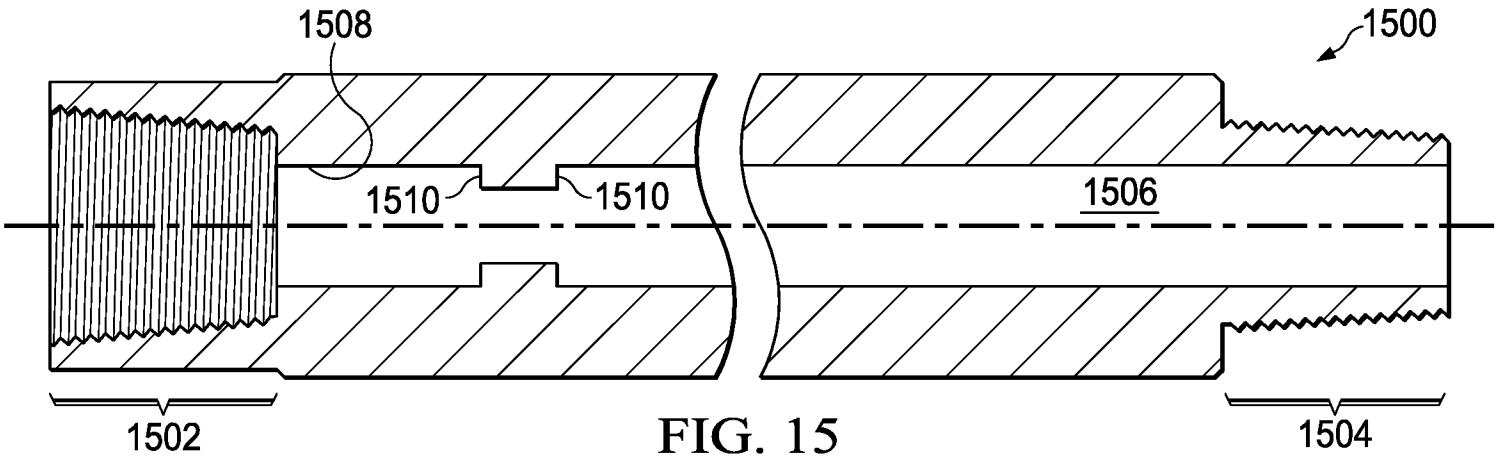
FIG. 15 is a cross-sectional view of a single orifice, bidirectional drill string pulsation dampening device according to embodiments of the present disclosure.

FIG. 15 is a cross-sectional view of a single orifice, bidirectional drill string pulsation dampening device according to embodiments of the present disclosure. The embodiment illustrated in FIG. 15 is for illustration only. FIG. 15 does not limit the scope of this disclosure to any particular implementation. This device maybe designed and installed where the square edges face both upstream and downstream.

Pulsation dampening device 1500 is suitable for use as either saver sub pulsation dampener device 139 or drill string pulsation dampening device 140 and/or 150. Pulsation dampening device 1500 includes an upper connection end 1502 receiving pumped fluid and having a female threaded connection and a lower connection end 1504 discharging pumped fluid and having a male threaded connection. Pulsation dampening device 1500 also includes an internal flow passage 1506 that extends generally axially through the pulsation dampening device 1500 from the upper connection end 1502 to the lower connection end 1504, through which pumped fluid flows predominantly from the upper connection end 1502 to the lower connection end 1504.

The internal flow passage 1506 includes a throat 1508 created by two orifice edges 1510. The "square edge"

pressure drop features are disposed facing opposite directions—both the direction of the source of the predominant fluid flow direction (that is, upstream) and the opposite direction (downstream). The features within internal flow passage 1506—orifice edges 1510—may be permanent within (machined into) the internal flow passage 1506, or may be replaceable.

FIG. 15 illustrates an elongated orifice effect relative to FIG. 4A (although pulsation dampening device 1500 has a similar end view to that shown in FIG. 4). While the length of saver sub pulsation dampener device 139 or drill string pulsation dampening device 140 and 150 may normally be a short distance, substantially shorter than a drill pipe segment, the length of the orifice inner diameter within the internal flow passage may alternatively be lengthened to better effect the waveform of the pulsation energy, and may extend nearly the entire length of a one segment of drill pipe (about 30 feet) as represented by the break lines.

Figure 16:
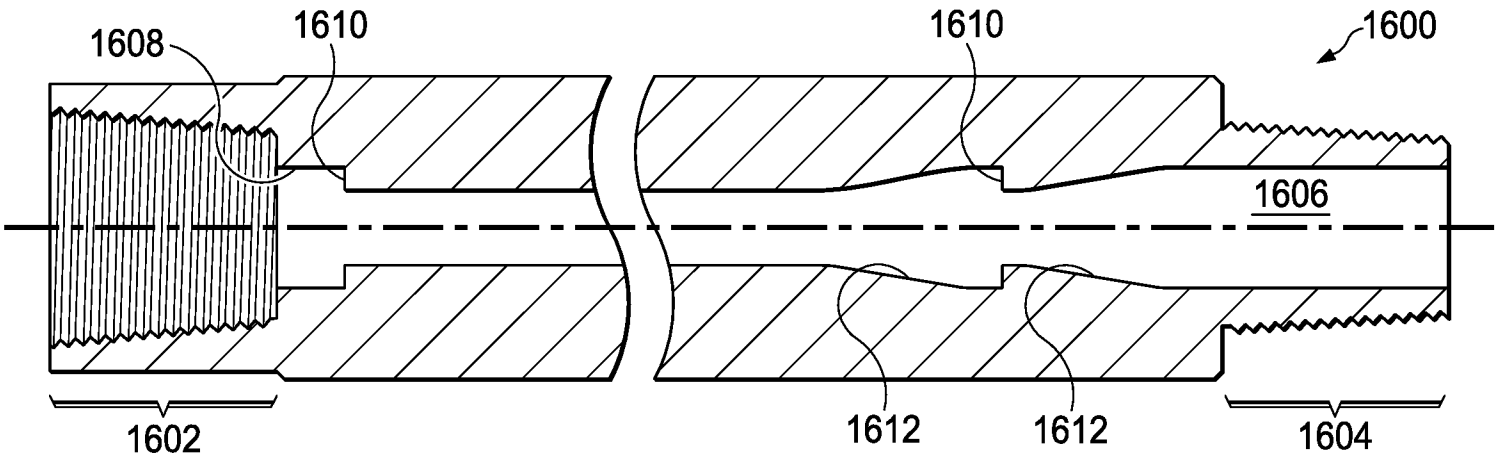
FIG. 16 is a cross-sectional view of a dual orifice, unidirectional drill string pulsation dampening device according to embodiments of the present disclosure.

FIG. 16 is a cross-sectional view of a dual orifice, unidirectional drill string pulsation dampening device according to embodiments of the present disclosure. The embodiment illustrated in FIG. 16 is for illustration only. FIG. 16 does not limit the scope of this disclosure to any particular implementation. This device maybe designed and installed where the square edges faces downhole.

Pulsation dampening device 1600 is suitable for use as either saver sub pulsation dampener device 139 or drill string pulsation dampening device 140 and 150. Pulsation dampening device 1600 includes an upper connection end 1602 receiving pumped fluid and having a female threaded connection and a lower connection end 1604 discharging pumped fluid and having a male threaded connection. Pulsation dampening device 1600 also includes an internal flow passage 1606 that extends generally axially through the pulsation dampening device 1600 from the upper connection end 1602 to the lower connection end 1604, through which pumped fluid flows predominantly from the upper connection end 1602 to the lower connection end 1604.

The internal flow passage 1606 includes a throat 1608, and square orifice edges 1610 and sloped relief features 1612. Both "square edge" pressure drop features are disposed facing the source of the predominant fluid flow direction—that is, upstream. The features within internal flow passage 1606—orifice edges 1610 and relief features 1612—may be permanent within (machined into) the internal flow passage 1606, or may be replaceable.

FIG. 16 illustrates an elongated orifice effect relative to FIG. 5A (although pulsation dampening device 1600 has a similar end view to that shown in FIG. 5). While the length of saver sub pulsation dampener device 139 or drill string pulsation dampening device 140 and 150 may normally be a short distance, substantially shorter than a drill pipe segment, the length of the orifice inner diameter within the internal flow passage may alternatively be lengthened to better effect the waveform of the pulsation energy, and may extend nearly the entire length of a one segment of drill pipe (about 30 feet) as represented by the break lines.

Figure 17:
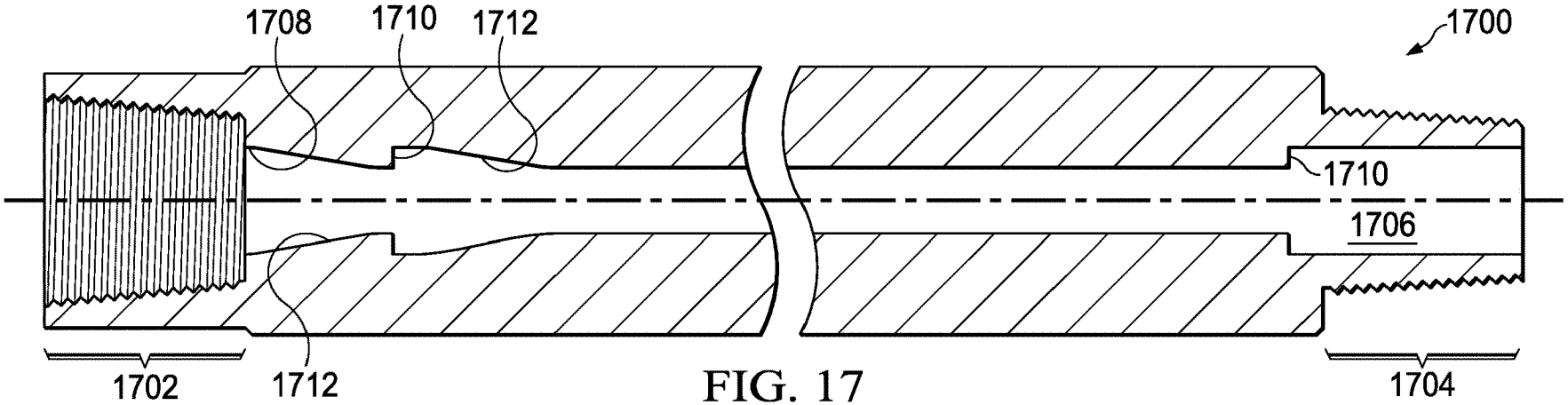
FIG. 17 is a cross-sectional view of a dual orifice, unidirectional drill string pulsation dampening device according to embodiments of the present disclosure.

FIG. 17 is a cross-sectional view of a dual orifice, unidirectional drill string pulsation dampening device according to embodiments of the present disclosure. The embodiment illustrated in FIG. 17 is for illustration only. FIG. 17 does not limit the scope of this disclosure to any particular implementation. This device has square edges facing the opposite direction from that shown in FIG. 16, but may be installed where the square edges face downhole.

Pulsation dampening device 1700 is suitable for use as either saver sub pulsation dampener device 139 or drill string pulsation dampening device 140 and 150. Pulsation dampening device 1700 includes an upper connection end 1702 receiving pumped fluid and having a female threaded connection and a lower connection end 1704 discharging pumped fluid and having a male threaded connection. Pulsation dampening device 1700 also includes an internal flow passage 1706 that extends generally axially through the pulsation dampening device 1700 from the upper connection end 1702 to the lower connection end 1704, through which pumped fluid flows predominantly from the upper connection end 1702 to the lower connection end 1704.

The internal flow passage 1706 includes a throat 1708, and square orifice edges 1710 and sloped relief features 1712. Both "square edge" pressure drop features are disposed facing the source of the predominant fluid flow direction—that is, upstream. The features within internal flow passage 1706—orifice edges 1710 and relief features 1712—may be permanent within (machined into) the internal flow passage 1706, or may be replaceable.

FIG. 17 illustrates an elongated orifice effect relative to FIG. 6A (although pulsation dampening device 1700 has a similar end view to that shown in FIG. 6). While the length of saver sub pulsation dampener device 139 or drill string pulsation dampening device 140 and 150 may normally be a short distance, substantially shorter than a drill pipe segment, the length of the orifice inner diameter within the internal flow passage may alternatively be lengthened to better effect the waveform of the pulsation energy, and may extend nearly the entire length of a one segment of drill pipe (about 30 feet) as represented by the break lines.

Figure 18:
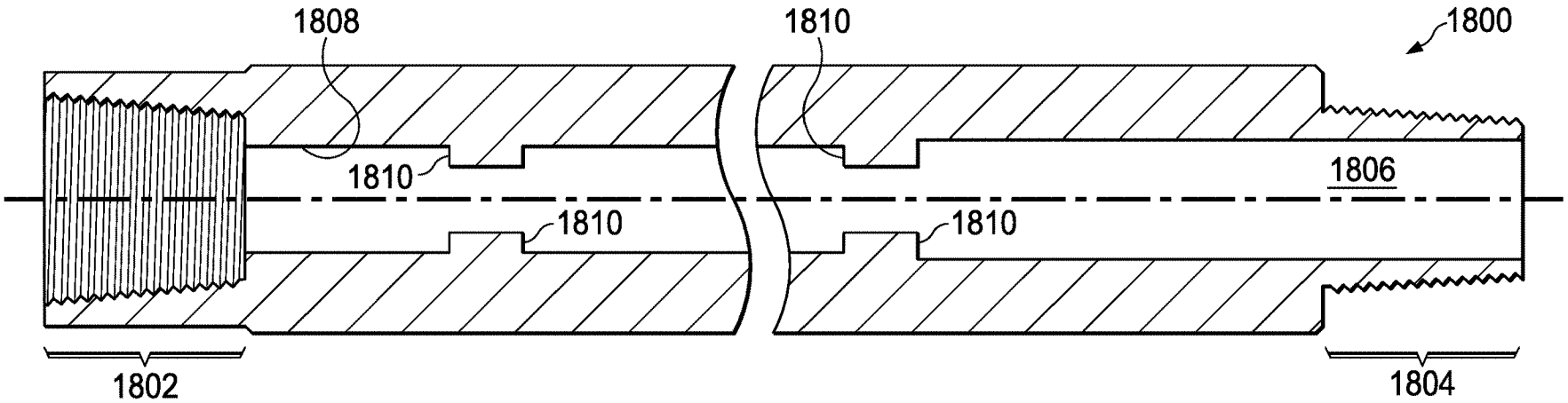
FIG. 18 is a cross-sectional view of a dual orifice, bidirectional drill string pulsation dampening device according to embodiments of the present disclosure.

FIG. 18 is a cross-sectional view of a dual orifice, bidirectional drill string pulsation dampening device according to embodiments of the present disclosure. The embodiment illustrated in FIG. 18 is for illustration only. FIG. 18 does not limit the scope of this disclosure to any particular implementation. This device has square edges facing both directions.

Pulsation dampening device 1800 is suitable for use as either saver sub pulsation dampener device 139 or drill string pulsation dampening device 140 and 150. Pulsation dampening device 1800 includes an upper connection end 1802 receiving pumped fluid and having a female threaded connection and a lower connection end 1804 discharging pumped fluid and having a male threaded connection. Pulsation dampening device 1800 also includes an internal flow passage 1806 that extends generally axially through the pulsation dampening device 1800 from the upper connection end 1802 to the lower connection end 1804, through which pumped fluid flows predominantly from the upper connection end 1802 to the lower connection end 1804.

The internal flow passage 1806 includes a throat 1808, and square orifice edges 1810. Both "square edge" pressure drop features are disposed facing either direction relative to the source of the predominant fluid flow direction (upstream). The features within internal flow passage 1806—orifice edges 1810—may be permanent within (machined into) the internal flow passage 1806, or may be replaceable.

FIG. 18 illustrates an elongated orifice effect relative to FIG. 7A (although pulsation dampening device 1800 has a similar end view to that shown in FIG. 8). While the length of saver sub pulsation dampener device 139 or drill string pulsation dampening device 140 and 150 may normally be a short distance, substantially shorter than a drill pipe segment, the length of the orifice inner diameter within the internal flow passage may alternatively be lengthened to better effect the waveform of the pulsation energy, and may extend nearly the entire length of a one segment of drill pipe (about 30 feet) as represented by the break lines.

Figure 19:
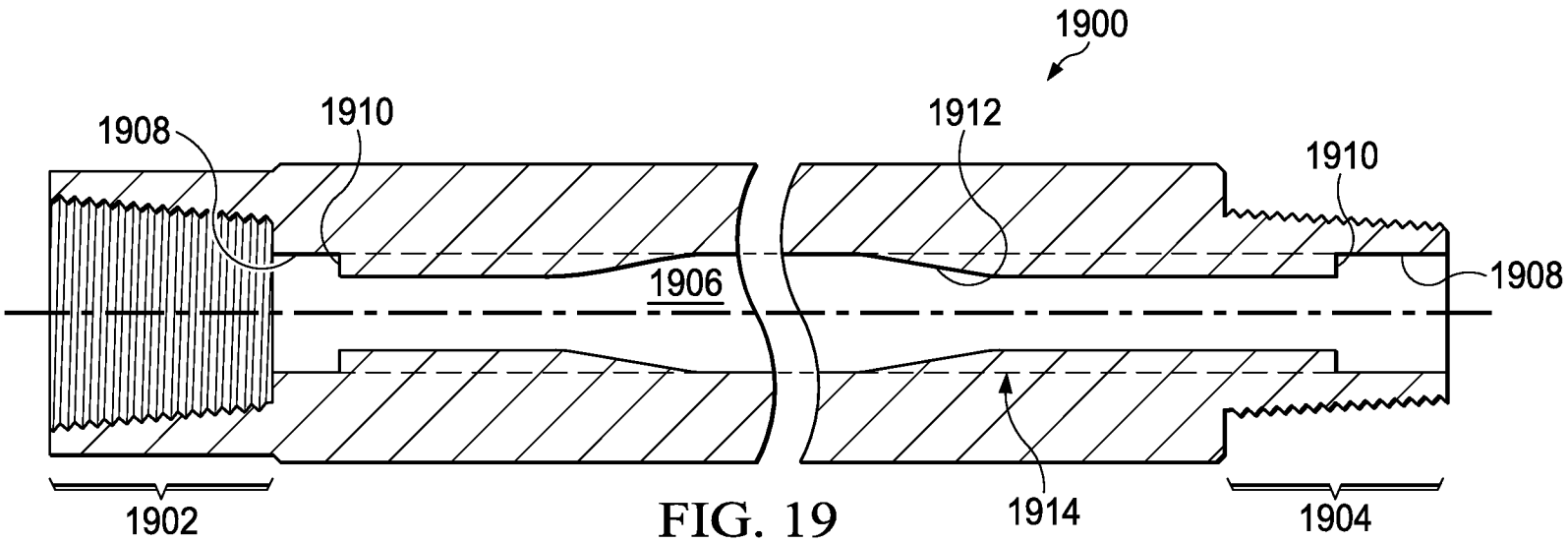
FIG. 19 is a cross-sectional view of a dual orifice, bidirectional drill string pulsation dampening device according to embodiments of the present disclosure.

FIG. 19 is a cross-sectional view of a dual orifice, bidirectional drill string pulsation dampening device according to embodiments of the present disclosure. The embodiment illustrated in FIG. 19 is for illustration only. FIG. 19 does not limit the scope of this disclosure to any particular implementation.

Pulsation dampening device 1900 is suitable for use as either saver sub pulsation dampener device 139 or drill string pulsation dampening device 140 and 150. Pulsation dampening device 1900 includes an upper connection end 1902 receiving pumped fluid and having a female threaded connection and a lower connection end 1904 discharging pumped fluid and having a male threaded connection. Pulsation dampening device 1900 also includes an internal flow passage 1906 that extends generally axially through the pulsation dampening device 1900 from the upper connection end 1902 to the lower connection end 1904, through which pumped fluid flows predominantly from the upper connection end 1902 to the lower connection end 1904.

The internal flow passage 1906 includes two throats 1908, one at either end, and two orifice edges 1910 and a relief feature 1912. The "square edge" pressure drop features are disposed facing both the source of the predominant fluid flow direction (upstream) and the opposite direction (downstream). The features within internal flow passage 1906—orifice edges 1910 and relief feature 1912—may be permanent within (machined into) the internal flow passage 1906, or may be replaceable as indicated by possible separation/replacement line 1914.

FIG. 19 illustrates an elongated orifice effect relative to FIG. 8A (although pulsation dampening device 1900 has a similar end view to that shown in FIG. 8). While the length of saver sub pulsation dampener device 139 or drill string pulsation dampening device 140 and 150 may normally be a short distance, substantially shorter than a drill pipe segment, the length of the orifice inner diameter within the internal flow passage may alternatively be lengthened to better effect the waveform of the pulsation energy, and may extend nearly the entire length of a one segment of drill pipe (about 30 feet) as represented by the break lines.

In the embodiments of any of FIGS. 2 and 2A, FIGS. 3 and 3A, FIGS. 4 and 4A, FIGS. 5 and 5A, FIGS. 6 and 6A, FIGS. 7 and 7A, FIGS. 8 and 8A, FIGS. 9 and 9A, FIGS. 10 and 10A, FIGS. 11 and 11A, FIGS. 12 and 12A, FIG. 13, FIG. 14, FIG. 15, FIG. 16, FIG. 17, FIG. 18, or FIG. 19, the pulsation dampening devices each include male and female connectors, and are normally installed with the male connection end facing downhole. However, other connection types may be used, and may be installed in other orientations or combinations. For instance, a male and male connection ends may be used, and the square edge of unidirectional flow restriction features may face downstream rather than upstream, to improve energy reduction by having the square edge facing the agitator rather than mud pump. For simplicity and clarity, all possible combinations and orientations are not being described herein, but such permutations of the disclosed connection ends and orientations are considered to be included within the scope of the present disclosure.

For bidirectional pressure drop devices, where there are two square edges with one facing upstream and the other downstream, the dimensions of the inner diameter may be based on the relative magnitudes of pressure pulsations from different sources (e.g., those from the mud pump may have higher intensity than those from the agitator). Even drill string pulsation dampening device 140 and 150, disposed within the borehole at one or multiple locations, may benefit to further dampening the pulsations coming from the mud pump. As discussed above, there may be a need for multiple devices at different locations, including even locations between the top drive (or swivel) and any standpipe.

Figure 20B:
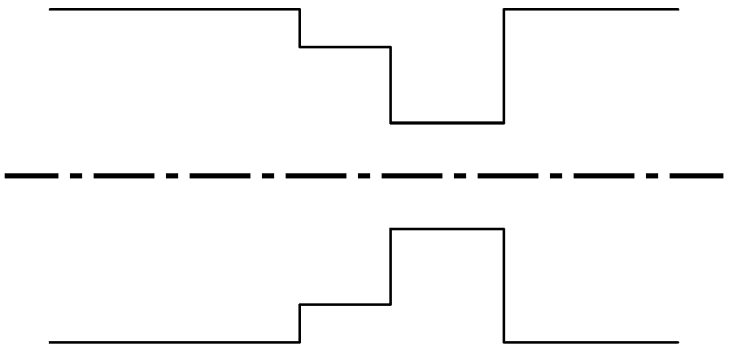
FIGS. 20A through 20D illustrate alternative surface shapes as seen in cross-section along a length of a pulsation dampening device according to embodiments of the present disclosure.
Figure 20A:
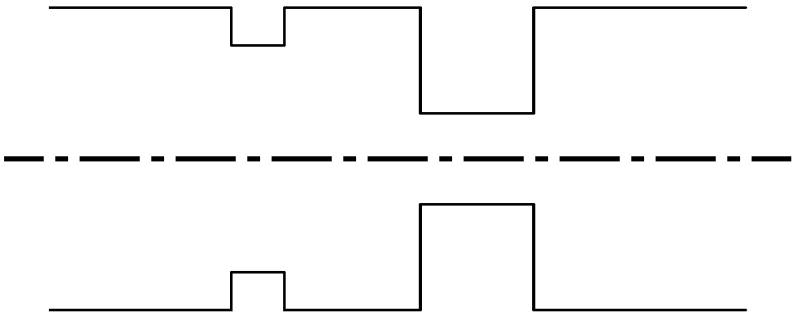
Figure 20D:
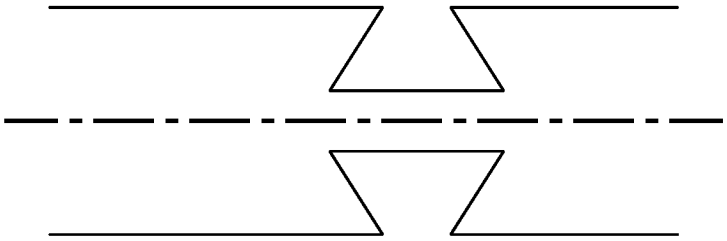
Figure 20C:
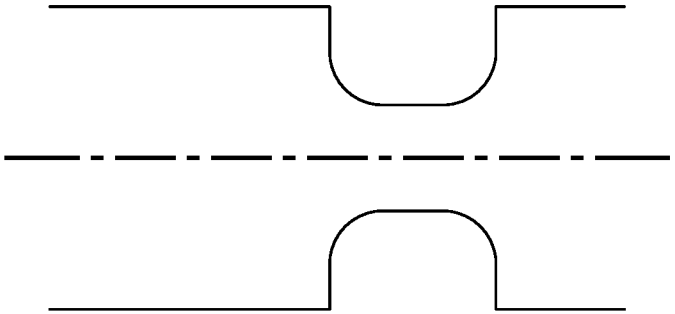

FIGS. 20A through 20D illustrate alternative surface shapes as seen in cross-section along a length of a pulsation dampening device according to embodiments of the present disclosure. The description above relates primarily to square edge or tapered/curved surface contours. However, other longitudinal surface contours may be employed, as illustrated by FIGS. 20A through 20D. For example, FIG. 20A illustrates an alternative surface contour for dual orifice, bidirectional pulsation dampening devices. Instead of square edge indentations of equal size as shown in FIG. 18, indentations of different sizes as illustrated in FIG. 20A may be employed. The same is true for tapered or curved surface contours in other embodiments described above: multiple tapered or curved features extending to different depths and/or having different slope may be employed at different points along the length inside a pulsation dampening device. Likewise, indentations need not be simple recesses with straight sidewalls and square (top and bottom) corners, but instead may be stepped recesses as illustrated by FIG. 20B, recesses with curved bottom corners as illustrated by FIG. 20C (or curved top corners, or sloped or chamfered top and/or bottom corners with straight, curved, or differently sloped sidewalls), and/or recesses with battered or (inwardly or outwardly) slanted sidewalls as illustrated by FIG. 20D.

Figure 21:
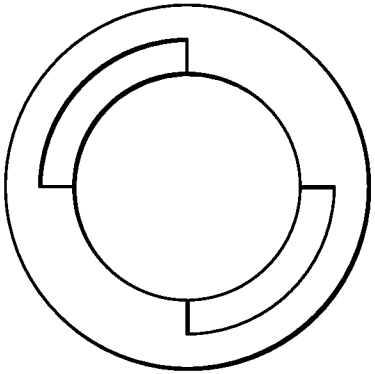
FIG. 21 illustrates an alternative surface shape as seen in cross-section across a length of a pulsation dampening device according to embodiments of the present disclosure.

FIG. 21 illustrates an alternative surface shape as seen in cross-section across a length of a pulsation dampening device according to embodiments of the present disclosure. The description above implies that surface contours are continuous and uniform around the entire interior circumference of the path of fluid flow. However, circumferentially discontinuous or non-uniform surface features may be employed. For example, FIG. 21 illustrates a segmented indentation in which only two quadrants include a recessed region corresponding to a square edge downstream (and/or upstream) from the section view shown. Those skilled in the art will understand that sidewalls of the discontinuous recess (or tapered/curved surface feature) need not be straight and radial as depicted, but that tapered or curved feature sidewalls (e.g., corresponding to changes in recess depth), non-radial feature sidewalls, and other variants may be employed for pressure pulsation control and/or for ease of manufacture.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. A pulsation dampening device for connection to a drill string, the pulsation dampening device comprising:

an internal flow path extending through an axial length of a body of one of a top drive or a saver sub; and a disruptive feature within the internal flow path, the disruptive feature comprising an orifice oriented to attenuate fluid pressure pulses emanating from downhole tools.

2. The pulsation dampening device of claim 1, wherein the orifice includes a cross-sectional area that is smaller than a cross-sectional area for the internal flow path in a region adjacent the orifice.

3. The pulsation dampening device of claim 1, wherein the orifice comprises a first orifice, the internal flow path further comprising:

a second orifice spaced apart along the internal flow path from the first orifice, wherein the second orifice includes a cross-sectional area that is one of equal to or different from the cross-sectional area for the first orifice.

4. The pulsation dampening device of claim 1, wherein the orifice comprises a first orifice, the internal flow path further comprising:

a relief feature disposed on one side of the orifice, the relief feature providing a gradual change in cross-sectional area of the internal flow path, and wherein the orifice and the relief feature cooperatively attenuate fluid pressure pulses emanating from surface mud pumps and the fluid pressure pulses emanating from the downhole tools.

5. The pulsation dampening device of claim 1, wherein the orifice comprises a stepped orifice formed by a first orifice having a first inner diameter contiguous with a second orifice having a second inner diameter smaller than the first inner diameter.

6. The pulsation dampening device of claim 1, further comprising a wear resistant material adjacent a surface of the orifice.

7. The pulsation dampening device of claim 1, wherein a spacing between the orifice and a second orifice or an end of a relief feature is selected based on a waveform of pulsation or acoustic energy within fluid passing through the internal flow path.

8. The pulsation dampening device of claim 1, wherein the orifice and an associated relief feature are one of:

integral portions of the internal flow path, or a removable insert secured within the internal flow path.

9. The pulsation dampening device of claim 1, wherein the orifice comprises a first orifice, the disruptive feature further comprising a second orifice spaced apart from the first orifice, wherein each of the first and second orifices has a cross-sectional area that is smaller than a cross-sectional area for the internal flow path between the first and second orifices, wherein the first and second orifices attenuate pulsation or acoustic energy within fluid passing through the internal flow path.

10. The pulsation dampening device of claim 1, wherein the pulsation dampening device is incorporated into the top drive.

11. The pulsation dampening device of claim 1, wherein the downhole tools comprise an agitator or an agitator and shock tool.

12. A drilling assembly, the drilling assembly comprising the pulsation dampening device according to claim 1, the drilling assembly further comprising a plurality of additional pulsation dampening devices, each of the additional pulsation dampening devices connected at a different one of multiple locations within a drill string between a drill string pipe below the top drive and the downhole tools.

13. A pulsation dampening device for connection to or within a drill string, the pulsation dampening device comprising:

a body having an upper connection end and a lower connection end, the upper connection end adapted to connect to one of a drill string feed connection, a top drive, a lower Kelly drive, a saver sub, or a first drill string pipe section, the lower connection end adapted to connect to one of a saver sub, a second drill string pipe, or a bottom hole assembly; and an internal flow path extending through an axial length of the body, the internal flow path including features configured with a disruptive feature oriented to attenuate fluid pressure pulses emanating from surface mud pumps and fluid pressure pulses emanating from downhole tools, the disruptive feature comprising a throat, the internal flow path further comprising:

a first orifice adjacent the throat and including a cross-sectional area that is smaller than a cross-sectional area for the internal flow path in a region of the throat, a first relief feature disposed on one side of the first orifice from the throat, the first relief feature providing a gradual change in the cross-sectional area of the internal flow path, a second orifice disposed on an opposite side of the first relief feature and the first orifice from the throat, the second orifice including sharp edges facing a direction that is one of toward or away from sharp edges of the first orifice, and a second relief feature disposed on one side of the second orifice from the throat, the second relief feature providing a gradual change in the cross-sectional area of the internal flow path, wherein the first and second orifices and the first and second relief features collectively attenuate fluid pressure pulses emanating from surface mud pumps and fluid pressure pulses emanating from downhole tools.

14. A pulsation dampening device for connection to a drill string, the pulsation dampening device comprising:

a body within one of a top drive or a saver sub; and an internal flow path extending through an axial length of the body, the internal flow path including a disruptive feature comprising an orifice oriented to attenuate fluid pressure pulses emanating from downhole tools, wherein the orifice is formed by a flow restriction orifice assembly disposed within the internal flow path, the flow restriction orifice assembly comprising:

an annular coupler secured within the internal flow path, the annular coupler having a cylindrical opening therethrough that is wider at ends of the annular coupler than at a middle to form shoulders internal to the cylindrical opening;

an annular hex nut externally having a hexagonal portion and a cylindrical portion, the hexagonal portion wider than the cylindrical portion and including a cylindrical opening that is wider than a cylindrical opening through the cylindrical portion to form an internal shoulder, the cylindrical portion received within an end of the annular coupler and abutting one internal shoulder internal to the cylindrical opening through the annular coupler; and an annular wear insert received by the cylindrical opening through the annular hex nut and abutting the internal shoulder internal to the cylindrical opening through the annular coupler.

15. A pulsation dampening device for connection to a drill string, the pulsation dampening device comprising:

a body within one of a top drive or a saver sub; and an internal flow path extending through an axial length of the body, the internal flow path including a disruptive feature comprising an orifice oriented to attenuate fluid pressure pulses emanating from downhole tools, wherein the orifice is formed by a flow restriction orifice assembly disposed within the internal flow path, the flow restriction orifice assembly comprising:

an annular retainer sleeve secured within the internal flow path, the annular retainer sleeve having a cylindrical opening having a first inner diameter along a portion of an axial length and a second inner diameter smaller than the first inner diameter along a remainder of the axial length to form a shoulder internal to the cylindrical opening;

an annular wear resistant insert received within the portion of the annular retainer sleeve having the first inner diameter and abutting the shoulder at a first end; and a snap ring abutting a second end of the annular wear resistant insert and received by a groove in the first inner diameter of the annular retainer sleeve.

16. A pulsation dampening device for connection to a drill string, the pulsation dampening device comprising:

a body within one of a top drive or a saver sub; and an internal flow path extending through an axial length of the body, the internal flow path including a disruptive feature comprising an orifice oriented to attenuate fluid pressure pulses emanating from downhole tools, wherein the orifice is formed by a flow restriction orifice assembly disposed within the internal flow path, the flow restriction orifice assembly comprising:

a cylindrical, annular collar secured within the internal flow path, and an annular wear insert having a first portion received by the cylindrical, annular collar and a second portion abutting a shoulder of the cylindrical, annular collar.

17. A pulsation dampening device for connection to a drill string, the pulsation dampening device comprising:

a saver sub having an upper threaded connection for connection to a top drive and a lower threaded connection for connection a first drill string pipe section below the top drive; and an internal flow path extending through an axial length of the saver sub, the internal flow path including a disruptive feature oriented to attenuate fluid pressure pulses emanating from surface mud pumps and fluid pressure pulses emanating from downhole tools.

18. The pulsation dampening device of claim 17, wherein the disruptive feature comprises an orifice formed by a flow restriction orifice assembly disposed within the internal flow path, the flow restriction orifice assembly comprising:

an annular coupler secured within the internal flow path, the annular coupler having a cylindrical opening therethrough that is wider at ends of the annular coupler than at a middle to form shoulders internal to the cylindrical opening;

an annular hex nut externally having a hexagonal portion and a cylindrical portion, the hexagonal portion wider than the cylindrical portion and including a cylindrical opening that is wider than a cylindrical opening through the cylindrical portion to form an internal shoulder, the cylindrical portion received within an end of the annular coupler and abutting one shoulder internal to the cylindrical opening through the annular coupler; and an annular wear insert received by the cylindrical opening through the annular hex nut and abutting the shoulder internal to the cylindrical opening through the annular coupler.

19. The pulsation dampening device of claim 17, wherein the disruptive feature comprises an orifice formed by a flow restriction orifice assembly disposed within the internal flow path, the flow restriction orifice assembly comprising:

an annular retainer sleeve secured within the internal flow path, the annular retainer sleeve having a cylindrical opening having a first inner diameter along a portion of an axial length and a second inner diameter smaller than the first inner diameter along a remainder of the axial length to form a shoulder internal to the cylindrical opening;

an annular wear insert received within the portion of the annular retainer sleeve having the first inner diameter and abutting the shoulder at a first end; and a snap ring abutting a second end of the annular wear insert and received by a groove in the first inner diameter of the annular retainer sleeve.

20. The pulsation dampening device of claim 17, wherein the disruptive feature comprises an orifice formed by a flow restriction orifice assembly disposed within the internal flow path, the flow restriction orifice assembly comprising:

an annular collar secured within the internal flow path, and an annular wear resistant insert having a first portion received by the annular collar and a second portion abutting a shoulder of the annular collar.

* * * * *